US008639498B2

(12) United States Patent
Beack et al.

(10) Patent No.: US 8,639,498 B2
(45) Date of Patent: Jan. 28, 2014

(54) APPARATUS AND METHOD FOR CODING AND DECODING MULTI OBJECT AUDIO SIGNAL WITH MULTI CHANNEL

(75) Inventors: Seung-Kwon Beack, Seoul (KR); Jeong-Il Seo, Daejon (KR); Tae-Jin Lee, Daejon (KR); Dae-Young Jang, Daejon (KR); Kyeong-Ok Kang, Daejon (KR); Jin-Woo Hong, Daejon (KR); Jin-Woong Kim, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 548 days.

(21) Appl. No.: 12/593,808

(22) PCT Filed: Mar. 31, 2008

(86) PCT No.: PCT/KR2008/001788
§ 371 (c)(1),
(2), (4) Date: Jan. 20, 2010

(87) PCT Pub. No.: WO2008/120933
PCT Pub. Date: Oct. 9, 2008

(65) Prior Publication Data

US 2010/0121647 A1 May 13, 2010

(30) Foreign Application Priority Data

Mar. 30, 2007 (KR) ..... 10-2007-0031820
Apr. 18, 2007 (KR) ..... 10-2007-0038027
Oct. 31, 2007 (KR) ..... 10-2007-0110319

(51) Int. Cl.
*G10L 19/00* (2013.01)

(52) U.S. Cl.
USPC ..... 704/200.1; 704/200; 704/500; 704/501

(58) Field of Classification Search
USPC ..... 704/200–201, 500–504
See application file for complete search history.

(56) References Cited

U.S. PATENT DOCUMENTS 7,275,031 B2 * 9/2007 Hoerich et al. ..... 704/230
7,974,847 B2 * 7/2011 Kjoerling et al. ..... 704/500

(Continued)

FOREIGN PATENT DOCUMENTS

JP 2008-535356 A 8/2008
JP 2009-524103 A 6/2009

(Continued)

OTHER PUBLICATIONS

Jurgen Herre, et al; "New Concepts in Parametric Coding of Spatial Audio: From SAC to SAOC", IEEE, Feb. 17-20, 2008, p. 1894-7.

(Continued)

*Primary Examiner* — Douglas Godbold
(74) *Attorney, Agent, or Firm* — Ladas & Parry LLP

(57) ABSTRACT

Provided are an apparatus and method for coding and decoding a multi object audio signal with multi channel. The apparatus includes: a multi channel encoding means for down-mixing an audio signal including a plurality of channels, generating a spatial cue for the audio signal including the plurality of channels, and generating first rendering information including the generated spatial cue; and a multi object encoding unit for down-mixing an audio signal including a plurality of objects, which includes the down-mixed signal from the multi channel encoding unit, generating a spatial cue for the audio signal including the plurality of objects, and generating second rendering information including the generated spatial cue, wherein the multichannel encoding unit generates a spatial cue for the audio signal including the plurality of objects regardless of a Coder-DECoder (CODEC) scheme the limits the multi channel encoding unit.

19 Claims, 12 Drawing Sheets

(56) References Cited

U.S. PATENT DOCUMENTS

| | | | | |
|---|---|---|---|---|
| 2006/0190247 | A1* | 8/2006 | Lindblom | 704/230 |
| 2007/0016427 | A1* | 1/2007 | Thumpudi et al. | 704/500 |
| 2008/0140426 | A1* | 6/2008 | Kim et al. | 704/500 |
| 2009/0125313 | A1* | 5/2009 | Hellmuth et al. | 704/501 |
| 2009/0125314 | A1* | 5/2009 | Hellmuth et al. | 704/501 |
| 2009/0157411 | A1* | 6/2009 | Kim et al. | 704/500 |
| 2009/0161795 | A1* | 6/2009 | Oh et al. | 375/316 |
| 2009/0164221 | A1* | 6/2009 | Kim et al. | 704/500 |
| 2009/0164222 | A1* | 6/2009 | Kim et al. | 704/500 |
| 2011/0013790 | A1* | 1/2011 | Hilpert et al. | 381/300 |
| 2011/0022402 | A1* | 1/2011 | Engdegard et al. | 704/501 |

FOREIGN PATENT DOCUMENTS

| | | | |
|---|---|---|---|
| JP | 2010-508545 | A | 3/2010 |
| JP | 2010-515099 | A | 5/2010 |
| WO | 2006/103584 | A1 | 10/2006 |
| WO | 2007/083957 | A1 | 7/2007 |
| WO | 2008/078973 | A1 | 7/2008 |
| WO | 2008/100100 | A1 | 8/2008 |

OTHER PUBLICATIONS

Kyungryeo1 Koo, et al; "Variable Subband Analysis for High Quality Spatial Audio Object Coding", IEEE, Feb. 17-20, 2008, p. 1205-8.

J. Breebaart, et al; "MPEG Spatial Audio Coding / MPEG Surround: Overview and Current Status", Audio Engineering Society Oct. 7-10, 2005, New York, USA.

International Search Report: PCT/KR2008/001788.

"ISO/IEC JTC 1/SC 29/WG 11N8329", International Organization for Standardization Organisation Internationale De Normalisation ISO/IEC JTC 1/SC 29/WG 11 Coding of Moving Pictures and Audio, Jul. 2006 8 pages.

"ISO/IEC JTC 1/SC29/WG 11M13632", International Organisation for Standardization Organisation Internationale Normalisation ISO/IEC JTC 1/SC 29/WG 11 Coding of Moving Pictures and Audio, Jul. 2006, 9 pages.

Christof Faller, et al; "Binaural Cue Coding—Part II", IEEE Transactions on Speech and Audio Processing, vol. 11, No. 6, pp, 520-531, Nov. 2003.

Frank Baumgarte, et al; "Binaural Cue Coding—Part 1", IEEE Transactions on Speech and Audio Processing, vol. 11, No. 6, pp. 509-519, Nov. 2003.

* cited by examiner

SAOC : SAOC bit stream not limited by SAC scheme {SAOC lower sub-band(additional sub-band) information (Pw_indx(b)) + additional information (IPD, OPD)}

SAOC' : SAC scheme-based SAOC bit stream {SAOC sub-band information}

SAC' : SAC + SAOC'

APPARATUS AND METHOD FOR CODING AND DECODING MULTI OBJECT AUDIO SIGNAL WITH MULTI CHANNEL

TECHNICAL FIELD

The present invention relates to coding and decoding a multi object audio signal with multi channel; and, more particularly, to an apparatus and method for coding and decoding a multi object audio signal with multi channel.

Here, the multi object audio signal with multi channel is a multi object audio signal including audio object signals each composed as various channels such as a mono channel, a stereo channel, and a 5.1 channel.

This work was supported by the IT R&D program of MIC/IITA [2007-S-004-01, "Development of glassless single user 3D broadcasting technologies"].

BACKGROUND ART

According to a related audio coding and decoding technology, a plurality of audio objects composed with various channels cannot be mixed according to user's needs. Therefore, audio contents cannot be consumed in various forms. That is, the related audio coding, and decoding technology only enables a user to passively consume audio contents.

As a related technology, a spatial audio coding (SAC) technology encodes a multi channel audio signal to a down mixed mono channel or a down mixed stereo channel signal with spatial cue information and transmits high quality multi channel signal even at a low bit rate. The SAC technology analyzes an audio signal by a sub-band and restores an original multi channel audio signal from the down mixed mono channel or the down mixed stereo channel signals based on the spatial cue information corresponding to each of the sub-bands. The spatial cue information includes information for restoring an original signal in a decoding operation and decides an audio quality of an audio signal reproduced in a SAC decoding apparatus. Moving Picture Experts Group (MPEG) has been progressing standardization of the SAC technology as MPEG Surround (MPS) and uses channel level difference (CLD) as spatial cue.

Since the SAC technology allows a user to encode and decode only one audio object of a multi channel audio signal, a user cannot encode and decode a multi object audio signal with multi channel using the SAC technology. That is, various objects of an audio signal composed with a mono channel, a stereo channel, and a 5.1 channel cannot be encoded or decoded according to the SAC technology.

As another related technology, a binaural cue coding (BCC) technology enables a user to encode and decode only a multi object audio signal with a mono channel. Thus, a user cannot encode or decode multi object audio signals with multiple channels, except the multi object audio signal with the mono channel, using the BCC technology.

As described above, the related technologies only allow a user to encode and decode a multi object audio signal with a mono channel or a single object audio signal with multi channel. That is, a multi object audio signal with multi channel cannot be encoded and decoded according to the related technologies. Therefore, a plurality of audio objects composed with various channels cannot be mixed in various ways according to a user's needs, and audio contents cannot be consumed in various forms. That is, the related technologies only enable a user to passively consume audio contents.

Therefore, there has been a demand for an apparatus and method for encoding and decoding a multi object audio signal with multi channel in order to enable a user to consume one audio contents in various forms by controlling the multi object audio signal according to user's needs.

DISCLOSURE

Technical Problem

An embodiment of the present invention is directed to providing an apparatus and method for encoding and decoding a multi object audio signal with multi channel.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided a multi channel encoding unit for down-mixing an audio signal including a plurality of channels, generating a spatial cue for the audio signal including the plurality of channels, and generating first rendering information including the generated spatial cue; and a multi object encoding unit for down-mixing an audio signal including a plurality of objects, which includes the down-mixed signal from the multi channel encoding unit, generating a spatial cue for the audio signal including the plurality of objects, and generating second rendering information including the generated spatial cue, wherein the multichannel encoding unit generates a spatial cue for the audio signal including the plurality of objects regardless of a Coder-DECoder (CODEC) scheme the limits the multi channel encoding unit.

In accordance with another aspect of the present invention, there is provided an audio encoding apparatus including: a multi channel encoding unit for down-mixing an audio signal including a plurality of channels, generating a spatial cue for the audio signal including the plurality of channels, and generating first rending information including the generated spatial cue; a multichannel encoding unit for down mixing an audio signal including a plurality of channels, generating a spatial cue for the audio signal including a plurality of channels, and generating first rendering information including the generated spatial cue; a first multi object encoding unit for down-mixing an audio signal including a plurality of objects having the down-mixed signal from the multi channel encoding unit, generating a spatial cue for the audio signal including the plurality of objects, and generating second rendering information including the generated spatial cue; and a second multi object encoding unit for down-mixing an audio signal including a plurality of objects, which includes the down mixed signal from the first multi object encoding unit, generating a spatial cue for the audio signal including the plurality of objects, and generating third rendering information including the generated spatial cue, wherein the second multi object encoding unit generates a spatial cue for the audio signal including the plurality of objects without being limited by a CODEC scheme that the multi channel encoding unit and the first multi object encoding unit are limited by.

In accordance with still another embodiment of the present invention, there is a provided a transcoding apparatus for generating rendering information to decode an encoded audio signal, including: a first matrix unit for generating rendering information including information for mapping the encoded audio signal to an output channel of an audio decoding apparatus based on object control information including location and level information of the encoded audio signal and output layout information; a second matrix unit for generating channel restoration information for a audio signal including a plurality of channels included in the encoded audio signal based on first rendering information including a spatial cue for the audio signal; a sub-band converting unit for converting second rendering information having a spatial cue for an audio signal including a plurality of objects included in the encoded audio signal into rendering information following the CODEC scheme, where the second rendering information includes a spatial cue not limited by a CODEC scheme that limits the first rendering information; and rendering unit for generating modified rendering information for the encoded audio signal based on the rendering information generated by the first matrix unit, the rendering information generated by the second matrix unit, and the converted rendering information from the sub-band converting unit.

In accordance with further still another embodiment of the present invention, there is a transcoding apparatus including: a Preset-ASI extracting unit for extracting predetermined Preset-ASI from the fourth rendering information; a first matrix unit for generating rendering information including information for mapping the encoded audio signal to an output channel of an audio decoding apparatus based on object control information directly expressing location and level information of the encoded audio signal and output layout information as the extracted Preset-ASI; a second matrix unit for generating channel restoration information for an audio signal including a plurality of channels based on first rendering information; a sub-band converting unit for converting third rendering information to rendering information following the CODEC scheme; and a rendering unit for generating modified rendering information for the encoded audio signal based on one of the extracted Preset-ASI and the generated rendering information from the generating rendering information, the generated rendering information from the generating channel restoration information, and the converted rendering information.

In accordance with yet another embodiment of the present invention, there is a transcoding apparatus for generating rendering information to decode an encoded audio signal, including: a first matrix unit for generating rendering information including information for mapping the encoded audio signal to an output channel of an audio decoding apparatus based on object control information having location and level information of the encoded audio signal and output layout information; a second matrix unit for generating channel restoration information for an audio signal including a plurality of channels based on first rendering information; a sub-band converting unit for converting third rendering information to rendering information following the CODEC scheme; and a rendering unit for generating modified rendering information for the encoded audio signal based on the generated rendering information from the first matrix unit, the generated rendering information from the second matrix unit, the converted rendering information from the sub-band converting unit, and second rendering information, wherein the first rendering information includes a spatial cue for an audio signal including a plurality of channels included in the encoded audio signal, the second rendering information includes a spatial cue for an audio signal including a plurality of objects, which includes an audio signal corresponding to the first rendering information, and the third rendering information includes a spatial cue generated in regardless of a CODEC scheme that limits the first rendering information and the second rendering information as a spatial cue for an audio signal including a plurality of objects, which includes an audio signal corresponding to the second rendering information.

In accordance with yet another embodiment of the present invention, there is a provided a transcoding apparatus including: a Preset-ASI extracting unit for extracting predetermined Preset-ASI from the fifth rendering information; a first matrix unit for generating rendering information including information for mapping the encoded audio signal to an output channel of an audio decoding apparatus based on object control information directly expressing location and level information of the encoded audio signal and output layout information as the extracted Preset-ASI; a second matrix unit for generating channel restoration information for an audio signal including a plurality of channels based on first rendering information; a sub-band converting unit for converting third rendering information to rendering information following the CODEC scheme; and a rendering unit for generating modified rendering information for the encoded audio signal based on one of the extracted Preset-ASI and the generated rendering information from the first matrix unit, the generated rendering information from the second matrix unit, and the converted rendering information from the sub-band converting unit.

In accordance with yet another embodiment of the present invention, there is a provided an audio decoding apparatus including: a parsing unit for separating rendering information of a multi object signal including a spatial cue for an audio signal including a plurality of objects and scene information of the audio signal including a plurality of objects from rendering information for a multi object audio signal including a plurality of channels; a signal processing unit for outputting a modified down mixed signal by performing high suppression on an audio object signal for an audio signal including a plurality of channels among down mixed signals for the multi object audio signal including a plurality of channels based on rendering information of the multi object signal; and a mixing unit for restoring an audio signal by mixing the modified down mixed signal based on the scene information.

In accordance with yet another embodiment of the present invention, there is a provided an audio decoding apparatus, including: a parsing unit for separating rendering information of a multi channel signal including a spatial cue for an audio signal including a plurality of channels, rendering information of a multi object signal including a spatial cue for an audio signal including a plurality of object, and scene information of the audio signal including a plurality of objects from rendering information for a multi object signal including a plurality of channels; a signal processing unit for generated a modified down mixed signal and a high-suppressed audio object signal by performing high suppression on at least one of audio object signals among down mixed signals for the multi object audio signal including a plurality of channels based on the rendering information of the multi object signal; a channel decoding unit for restoring a multi channel audio signal by mixing the modified down mixed signal; and a mixing unit for mixing the modified down mixed signal and an audio object signal generated by the signal processing unit based on the scene information.

In accordance with yet another embodiment of the present invention, there is a provided an audio encoding method including: down-mixing an audio signal including a plurality of channels, generating a spatial cue for the audio signal including the plurality of channels, and generating first rendering information including the generated spatial cue; and down-mixing an audio signal including a plurality of objects, which includes the down-mixed signal from the down-mixing an audio signal including a plurality of channels, generating a spatial cue for the audio signal including the plurality of objects, and generating second rendering information including the generated spatial cue, wherein in the down-mixing an audio signal including a plurality of objects, a spatial cue for the audio signal including the plurality of objects is generated regardless of a Coder-DECoder (CODEC) scheme the limits down-mixing an audio signal including a plurality of objects.

In accordance with yet another embodiment of the present invention, there is a provided an audio encoding method including: down-mixing an audio signal including a plurality of channels, generating a spatial cue for the audio signal including the plurality of channels, and generating first rending information including the generated spatial cue; down mixing an audio signal including a plurality of channels, generating a spatial cue for the audio signal including a plurality of channels, and generating first rendering information including the generated spatial cue; down-mixing an audio signal including a plurality of objects having the down-mixed signal from the down mixing an audio signal including a plurality of channels, generating a spatial cue for the audio signal including the plurality of objects, and generating second rendering information including the generated spatial cue; and down-mixing an audio signal including a plurality of objects, which includes the down mixed signal from the down mixing an audio signal including a plurality of channels, generating a spatial cue for the audio signal including the plurality of objects, and generating third rendering information including the generated spatial cue, wherein in the down mixing an audio signal including a plurality of objects, a spatial cue for the audio signal including the plurality of objects is generated regardless of a CODEC scheme that limits the multi channel encoding unit and the first multi object encoding unit.

In accordance with yet another embodiment of the present invention, there is a provided a transcoding method for generating rendering information to decode an audio signal encoded by the audio encoding method, including: generating rendering information including information for mapping an encoded audio signal to an output channel of an audio decoding apparatus based on object control information including location and level information of the encoded audio signal and output layout information; generating channel restoration information for a audio signal including a plurality of channels included in the encoded audio signal based on first rendering information including a spatial cue for the audio signal; converting second rendering information having a spatial cue for an audio signal including a plurality of objects included in the encoded audio signal into rendering information following the CODEC scheme, where the second rendering information includes a spatial cue not limited by a CODEC scheme that limits the first rendering information; and generating modified rendering information for the encoded audio signal based on the rendering information from the generating rendering information, the rendering information generated from the generating channel restoration information, and the converted rendering information from the converting second rendering information.

In accordance with yet another embodiment of the present invention, there is a provided a transcoding method for generating rendering information to decode an audio signal encoded by the audio encoding method, including: extracting predetermined Preset-ASI from the fourth rendering information; generating rendering information including information for mapping the encoded audio signal to an output channel of an audio decoding apparatus based on object control information directly expressing location and level information of the encoded audio signal and output layout information as the extracted Preset-ASI; generating channel restoration information for an audio signal including a plurality of channels based on first rendering information; converting third rendering information to rendering information following the CODEC scheme; and generating modified rendering information for the encoded audio signal based on one of the extracted Preset-ASI and the generated rendering information from the generating rendering information, the generated rendering information from the generating channel restoration information, and the converted rendering information.

In accordance with yet another embodiment of the present invention, there is a provided a transcoding method for generating rendering information to decode an audio signal encoded by the audio encoding method, including: generating rendering information including information for mapping the encoded audio signal to an output channel of an audio decoding apparatus based on object control information having location and level information of the encoded audio signal and output layout information; generating channel restoration information for an audio signal including a plurality of channels based on first rendering information; converting third rendering information to rendering information following the CODEC scheme; and generating modified rendering information for the encoded audio signal based on the generated rendering information from the generating rendering information, the generated rendering information from the generating channel restoration information, the converted rendering information from the converting third rendering information, and second rendering information.

In accordance with yet another embodiment of the present invention, there is a provided a transcoding method for generating rendering information to decode an audio signal encoded by the audio encoding method, including: extracting predetermined Preset-ASI from the fifth rendering information; generating rendering information including information for mapping the encoded audio signal to an output channel of an audio decoding apparatus based on object control information directly expressing location and level information of the encoded audio signal and output layout information as the extracted Preset-ASI; generating channel restoration information for an audio signal including a plurality of channels based on first rendering information; converting third rendering information to rendering information following the CODEC scheme; and generating modified rendering information for the encoded audio signal based on one of the extracted Preset-ASI and the generated rendering information from the generating rendering information, the generated rendering information from the generating channel restoration information, and the converted rendering information.

In accordance with yet another embodiment of the present invention, there is a provided an audio decoding method including: separating rendering information of a multi object signal including a spatial cue for an audio signal including a plurality of objects and scene information of the audio signal including a plurality of objects from rendering information for a multi object audio signal including a plurality of channels; outputting a modified down mixed signal by performing high suppression on an audio object signal for an audio signal including a plurality of channels among down mixed signals for the multi object audio signal including a plurality of channels based on rendering information of the multi object signal; and restoring an audio signal by mixing the modified down mixed signal based on the scene information.

In accordance with yet another embodiment of the present invention, there is a provided an audio decoding method including: separating rendering information of a multi channel signal including a spatial cue for an audio signal including a plurality of channels, rendering information of a multi object signal including a spatial cue for an audio signal including a plurality of object, and scene information of the audio signal including a plurality of objects from rendering information for a multi object signal including a plurality of channels; generated a modified down mixed signal and a high-suppressed audio object signal by performing high suppression on at least one of audio object signals among down mixed signals for the multi object audio signal including a plurality of channels based on the rendering information of the multi object signal; restoring a multi channel audio signal by mixing the modified down mixed signal; and mixing the modified down mixed signal and an audio object signal generated by the signal processing means based on the scene information.

In accordance with yet another embodiment of the present invention, there is a provided an audio encoding apparatus including: an input unit for receiving a multi channel audio signal and a multi object audio signal; and an encoding unit for encoding the received audio signal to a down mixed signal and rendering information, wherein the rendering information includes multi channel coding supplementary information and multi object coding supplementary information.

In accordance with yet another embodiment of the present invention, there is a provided an audio decoding method, including: receiving an audio coding signal including a down mixed signal and a supplementary information signal; extracting multi object supplementary information and multi channel supplementary information from the supplementary information signal; converting the down mixed signal to a multi channel down mixed signal based on the multi object supplementary information; decoding a multi channel audio signal using the multi channel down mixed signal and the multi channel supplementary information; and mixing the decoded audio signal.

Advantageous Effects

According to the present invention, a user is enabled to encode and decode a multi object audio signal with multi channel in various ways. Therefore, audio contents can be actively consumed according to a user's need.

BEST MODE FOR THE INVENTION

The advantages, features and aspects of the invention will become apparent from the following description of the embodiments with reference to the accompanying drawings, which is set forth hereinafter.

Figure 1:
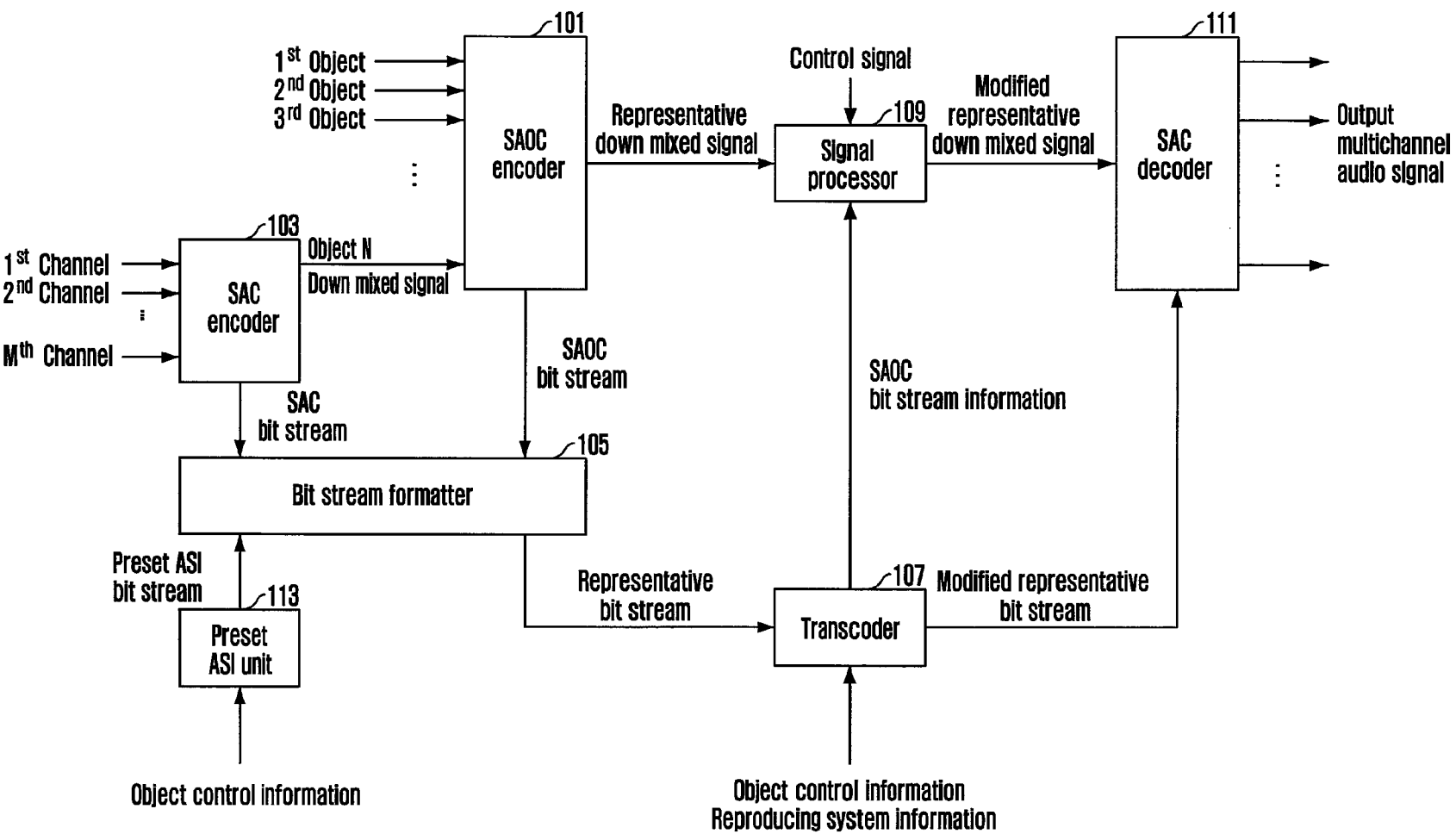
FIG. 1 is a diagram illustrating an audio encoding apparatus and an audio decoding apparatus in accordance with an embodiment of the present invention.

FIG. 1 is a diagram illustrating an audio encoding apparatus and an audio decoding apparatus in accordance with an embodiment of the present invention.

As shown in FIG. 1, the audio encoding apparatus according to the present embodiment includes a Spatial Audio Object Coding (SAOC) encoder 101, a Spatial Audio Coding (SAC) encoder 103, a bit stream formatter 105, and a Preset-Audio Scene Information (Preset-ASI) unit 113.

The SAOC encoder 101 is a spatial cue based encoder employing a SAC technology. The SAOC encoder 101 down mixes a plurality of audio objects composed with a mono channel or a stereo channel into one signal composed with a mono channel or a stereo channel. The encoded audio objects are not independently restored in an audio decoding apparatus. The encoded audio objects are restored to a desired audio scene based on rendering information of each audio object. Therefore, the audio decoding apparatus needs a structure for rendering an audio object for the desired audio scene. The rendering is a process of generating an audio signal by deciding a location to output the audio signal and a level of the audio signal.

The SAOC technology is a technology for coding multi objects based on parameters. The SAOC technology is designed to transmit N audio object using an audio signal with M channels, where M and N are integers and M is smaller than N (M<N). With the down mixed signal, object parameters are transmitted for recreation and manipulation of an original object signal. The object parameters may be information on a level difference between objects, absolute energy of an object, and correlation between objects. According to the SAOC technology, N audio objects may be recreated, modified, and rendered based on transmitted M (<N) channel signals and a SAOC bit stream having spatial cue information and supplementary information. The M channel signals may be a mono channel signal or a stereo channel signal. The N audio objects may be a mono channel signal or a stereo channel signal. Also, the N audio objects may be a MPEG Surround (MPS) multichannel object. The SAOC encoder extracts the object parameters as well as down mixing the inputted object signal. The SAOC decoder reconstructs and renders an object signal from the down mixed signal to be suitable to a predetermined number of reproduction channels. A reconstruction level and rendering information including a panning location of each object may be inputted from a user. An outputted sound scene may have various channels such as a stereo channel or 5.1 channels and is independent from the number of inputted object signals and the number of down mix channels.

The SAOC encoder 101 down mixes an audio object that is directly inputted or outputted from the SAC encoder 103 and outputs a representative down mixed signal. Meanwhile, the SAOC encoder 101 outputs a SAOC bit stream having spatial cue information for inputted audio objects and supplementary information. Here, the SAOC encoder 101 may analyze an inputted audio object signal using "heterogeneous layout SAOC" and a "Faller" scheme.

Throughout the specification, the spatial cue information is analyzed and extracted by a sub-band unit of a frequency domain. In the present embodiment, usable spatial cue is defined as follows.

CLD [Channel(Audio Signal) Level Difference]: level difference between input audio signals ICC [Inter Channel Correlation]: correlation between inputted audio signals CTD [Channel(Audio Signal) Time Difference]: time difference between inputted audio signals CPC [Channel Prediction Coefficient]: down mix ration of inputted audio signal That is, CLD denotes information on a power gain of an audio signal, ICC is information on correlation between audio signals, CTD is information on time difference between audio signals, and CPC denotes information on down mix gain when an audio signal is down mixed.

A major role of a spatial cue is to sustain a spatial image, that is, a sound scene. Therefore, the sound scene may be composed through the spatial cue. In a view of an audio signal reproduction environment, a spatial cue including the most information is CLD. That is, a basic output signal may be generated using only CLD. Therefore, an embodiment of the present invention will be described based on CLD, hereinafter. However, the present invention is not limited to CLD. It is obvious to those skilled in the art that the present invention may include various embodiments related to various spatial cues.

The additional information includes spatial information for restoring and controlling audio objects inputted to the SAOC encoder 101. The additional information defines identification information for each of inputted audio objects. Also, the additional information defines channel information of each inputted audio object such as a mono channel, a stereo channel, or multichannel. For example, the additional information may include header information, audio object information, present information and control information for removing objects.

Meanwhile, the SAOC encoder 101 may generate spatial cue parameters based on a plurality of sub-bands which is more than the number of sub-bands restricted by a SAC scheme, that is, additional sub-bands. The SAOC encoder 101 calculates an index of a sub-band having dominant power, Pw_indx(b), based on following Eq. 13. It will be fully described in later. The index of sub-band Pw_indx(b) may be included in the SAOC bit stream.

Throughout the specification, a SAC scheme, a SAC encoding and decoding scheme, or a SAC CODEC scheme are conditions that the SAC encoder 103 must follow in order to generate spatial cue information for an inputted multichannel audio signal. A representative example of the SAC scheme is the number of sub-bands for generating the spatial cue.

The SAC encoder 103 generates an audio object by down mixing a multi-channel audio signal to a mono channel audio signal or a stereo channel audio signal. Meanwhile, the SOC encoder 103 outputs a SAC bit stream that includes spatial cue information and additional information for an inputted multichannel audio signal.

For example, the SAC encoder 103 may be a Binaural Cue Coding (BCC) encoder or a MPEG Surround (MPS) encoder.

The audio object signal outputted from the SAC encoder 103 is inputted to the SAOC encoder 101. Unlike an audio object that is directly inputted to the SAOC encoder 101, an audio object inputted from the SAC encoder 103 to the SAOC encoder 101 may be a background scene object. As the background scene object which is a multichannel audio signal, one audio object which is the down mixed signal by the SAC encoder 103 may be a Music Recorded (MR) version of a signal with a plurality of audio objects reflected according to a previous predetermined audio scene or intention of production for audio contents.

The Preset-ASI unit 113 forms Preset-ASI based on a control signal inputted from an external device, that is, object control information, and generates a Preset-ASI bit stream including the Preset-ASI. The Preset-ASI will be fully described with reference to FIGS. 10 and 11.

The bit stream formatter 105 generates a representative bit stream by combining a SAOC bit stream outputted from the SAOC encoder 101, a SAC bit stream outputted from the SAC encoder 103, and a Preset-ASI bit stream outputted from the Preset-ASI unit 113.

Figure 2:
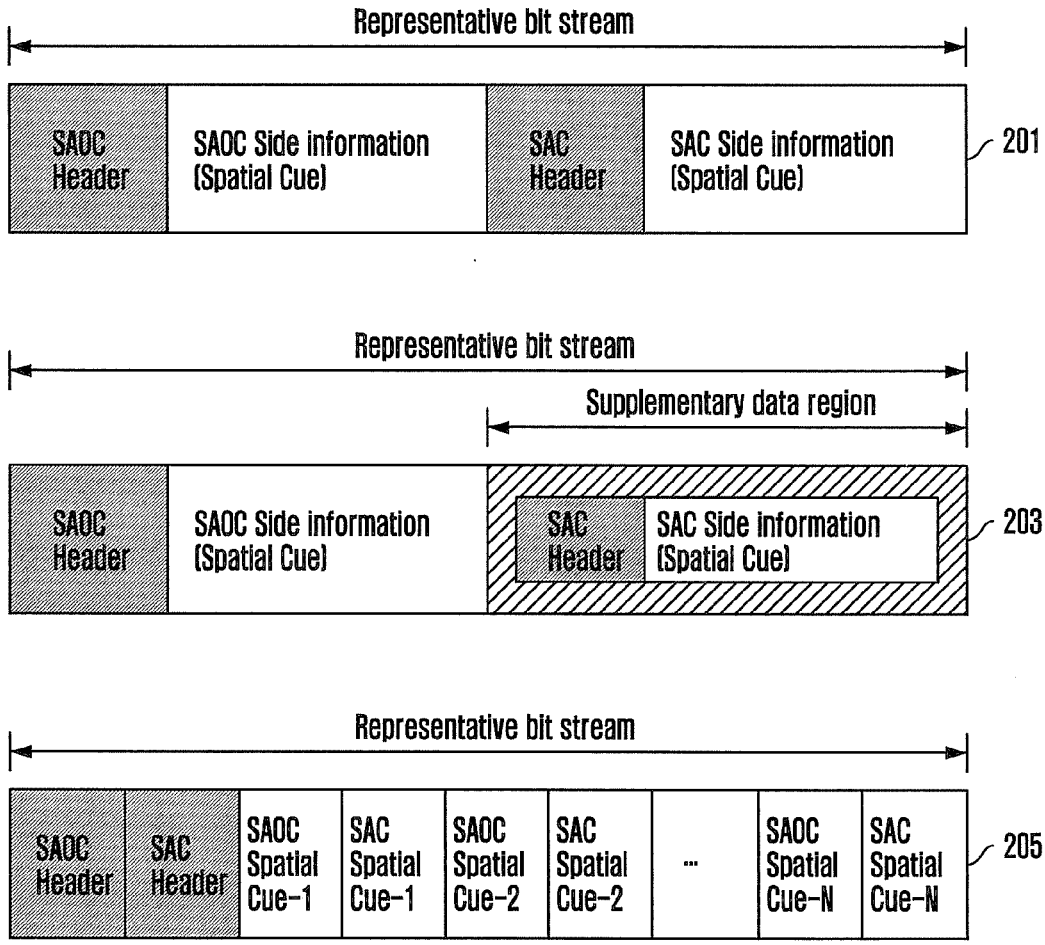
FIG. 2 is a diagram illustrating a representative bit stream generated from a bit stream formatter (105).

FIG. 2 is a diagram illustrating a representative bit stream generated from the bit stream formatter 105.

Referring to FIG. 2, the bit stream formatter 105 generates a representative bit stream based on a SAOC bit stream generated by the SAOC encoder 101 and a SAC bit stream generated by the SAC encoder 103.

In the present embodiment, the representative bit stream may have following three structures.

In a first structure 201 of the representative bit stream, a SAOC bit stream and a SAC bit stream are connected in serial. In a second structure 203 of the representative bit stream, a SAC bit stream is included in an ancillary data region of a SAOC bit stream. A third structure 205 of the representative bit stream includes a plurality of data regions, and each of data regions includes corresponding data of a SAOC bit stream and a SAC bit stream. For example, in the third structure 205, a header region includes a SAOC bit stream header and a SAC bit stream header. Also, the third structure 205 includes information on SAOC bit stream and SAC bit stream grouped based on a predetermined CLD.

Meanwhile, a SAOC bit stream header includes audio object identification information, sub-band information, and additional spatial cue identification information, which are defined in following table 1. Here, the controllable audio object means sub-band information not limited by a SAC scheme and an audio object analyzed through additional information.

TABLE 1

| Information | Contents |
|---|---|
| ID of Target audio object | Identification for an audio object with spatial cue parameters generated by a supplementary sub-band unit which is a sub-band unit having sub-bands more than the number of sub-bands limited by a SAC scheme. An audio object marked by this identification can be controlled. |

TABLE 1-continued

| Information | Contents |
|---|---|
| | For example, identification for [N-1] audio objects directly inputted to a SAOC encoder 101 of FIG. 1. Identification for C audio objects directly inputted to a second encoder 509 of FIG. 5. |
| Type of parameter bands | Information on a sub-band type for generating a spatial cue. For example, sub-band type information such as 28 bands, 60 bands, and 71 bands |
| ID of type of additional parameters | Identification information for corresponding additional parameters when transmitting additional parameters [for example IPD, OPD] except basic spatial cue parameter [for example, CLD, ICC, CTD, CPC] |

Although three possible structures for the representative bit stream according to the present embodiment are disclosed, the present invention is not limited thereto. It is obvious that the SAOC bit stream and the SAC bit stream may be combined in various forms.

The representative bit stream may include a Preset-ASI bit stream generated by the Present-ASI unit 113.

Figure 10:
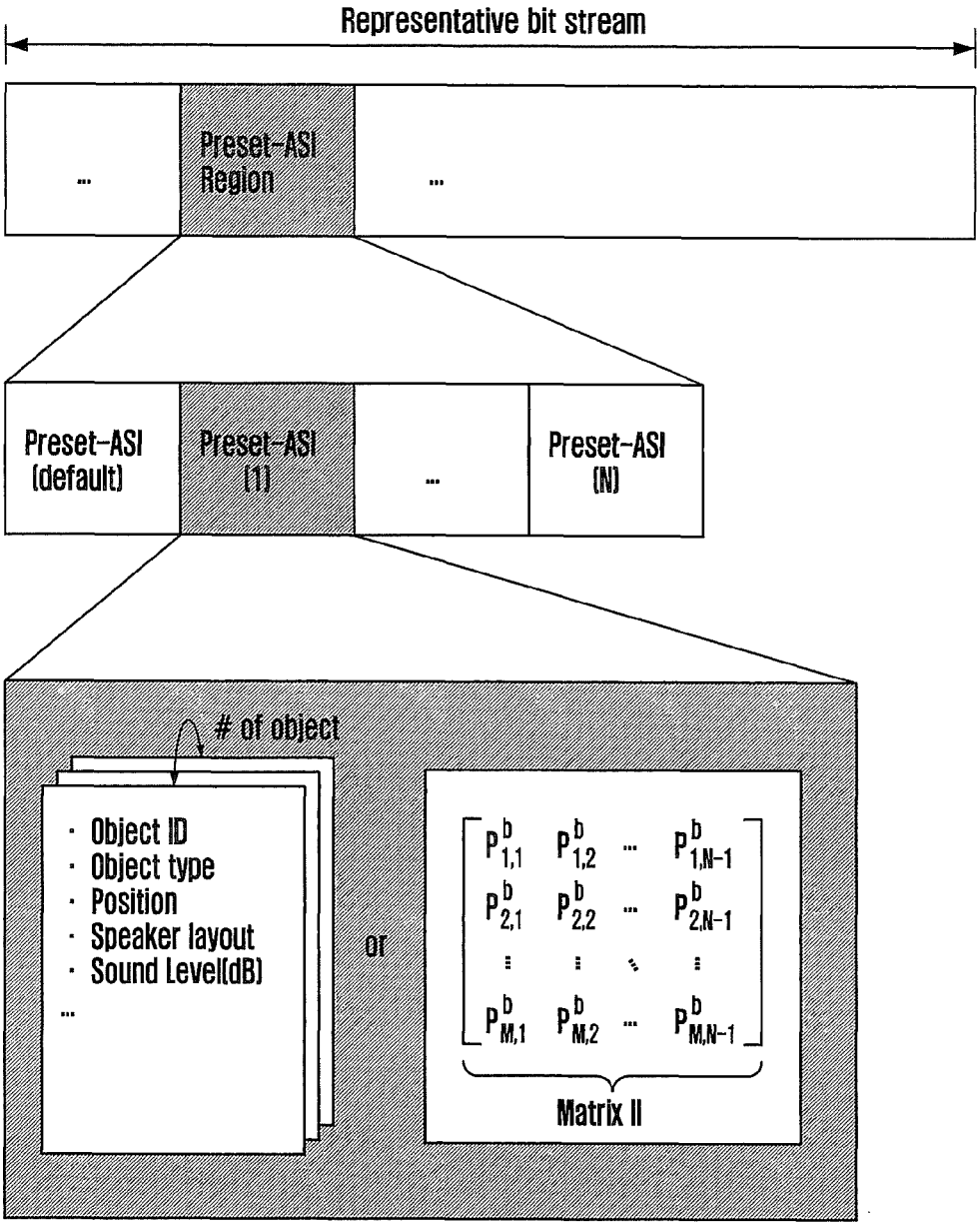
FIG. 10 is a diagram illustrating a structure of a representative bit stream outputted from the bit stream formatter 105 according to another embodiment of the present invention. The representative bit stream of FIG. 10 includes Preset-ASI information.

FIG. 10 is a diagram illustrating a structure of a representative bit stream outputted from the bit stream formatter 105 according to another embodiment of the present invention. The representative bit stream of FIG. 10 includes Preset-ASI.

As shown in FIG. 10, the representative bit stream includes a Preset-ASI region. The Preset-ASI region includes a plurality of Preset-ASI each including default Preset-ASI. The Preset-ASI includes object control information having information on a location and a level of each audio object and output layout information. That is, the Preset-ASI denotes a location and a level of each audio object for composing speaker layout information and an audio scene suitable to layout information of speakers. The default Preset-ASI is scene information for basic output.

The transcoder 107 renders an audio object using the object control information. Meanwhile, the object control information may be setup as a predetermined threshold value, for example, default Preset-ASI.

The object control information includes additional information and header information of a representative bit stream. The object control information may be expressed as two types. At first, location and level information of each audio object and output layout information may be directly expressed. Secondly, location and level information of each audio object and output layout information may be expressed as a first matrix I which will be described in later. It may be used as a first matrix of the first matrix unit 3113 which will be described in later.

In case of directly expressing object control information included in the Preset-ASI, the Preset-ASI may include layout information of a reproducing system such as a mono channel, a stereo channel, or a multichannel, an audio object ID, audio object layout information such as a mono channel or a stereo channel, an audio object location, for example, Azimuth expressed as 0 degree to 360 degree, Elevation expressed as −50 degree to 90 degree, and audio object level information expressed as −50 dB to 50 dB.

In case of expressing the object control information included in the Preset-ASI in a form of a first matrix I, a matrix P of Eq. 6 having the Preset-ASI reflected is transmitted to the rendering unit 1103. The first matrix I includes power gain information to be mapped to a channel outputting each of audio objects or phase information as factor vectors.

The Preset-ASI may define various audio scenes corresponding to a target reproducing scenario. For example, Preset-ASI, required by a multichannel reproducing system, such as stereo, 5.1 channel, or 7.1 channel, may be defined corresponding to intension of a content producer and an object of a reproducing service.

Referring to FIG. 1 again, a SAC bit stream outputted from the SAC encoder 103 includes spatial cue information of a multichannel audio signal and is dependent to a SAC encoding and decoding scheme. For example, if the SAC decoder 111 includes 28 sub-bands as a MPEG Surround (MPS) decoder, the SAC encoder 103 must generate a spatial cue by a unit of 28 sub-bands. For example, the SAC encoder 103 transforms a first channel signal Channel 1 and a second channel signal Channel 2, which is an input audio signal, to a frequency domain by a frame unit, and generates spatial cue by analyzing the transformed frequency domain signal by a fixed sub-band unit. For example, CLD, one of spatial cues, is generated by Eq. 1.

$$CLD(b) = \sqrt{\frac{\sum_{k=A(b)}^{A(b)-1} \text{Power}(channel1(k))}{\sum_{k=A(b)}^{A(b)-1} \text{Power}(channel2(k))}} \quad \text{Eq. 1}$$

$$0 \le b \le S-1$$

In Eq. 1, S denotes the number of sub-bands, b is a sub-band index, k is a frequency coefficient, and A(b) is a boundary of a frequency domain of a bth sub-band. Eq. 1 may be defined by exchanging the numerator and the denominator of Eq. 1. In general, a spatial cue is generated by analyzing one audio signal frame by the fixed number of sub-bands such as 20 or 28 according to the MPEG Surround (MPS) scheme.

However, the SAOC encoder 101 may be independent from the SAC scheme. A spatial cue of an audio object which is analyzed by the SAOC encoder 101 regardless of the SAC scheme may include more information than a spatial cue of an audio object analyzed according to the SAC scheme, for example, more sub-band information or additionally includes additional information not limited by the SAC scheme.

The sub-band information or additional information not limited by the SAC scheme is effectively used in the signal processor 109. Audio object decomposition capability is improved according to the SAC scheme through sub-band information or supplementary information, which is independent from the SAC scheme while the signal processor 109 removes predetermined audio object components from a representative down mixed signal, for example, when the signal processor 109 removes all of audio object signals outputted from the SAC encoder 105 from a representative down mixed signal outputted from the SAOC encoder 101 except an object N, or when the signal processor 109 removes the object N only.

Finally, a capability of removing predetermined audio object can be further improved through the sub-band information or additional information which is independent from the SAC scheme. If the audio object removing capability is improved, it is possible to accurately and clearly remove an audio object from a representative down mixed signal, that is, high suppression.

That is, the SAOC encoder 101 may generate spatial cue for more sub-bands, that is, a spatial cue for further higher resolution of a sub-band and supplementary spatial cue independently from the SAC scheme. The SAOC encoder 101 is not limited by the fixed number of sub-bands. Therefore, since an audio object for a spatial cue generated independently from the SAOC encoder 101 include further greater supplementary information, high suppression is enabled.

The signal processor 109 outputs a representative down mixed signal modified by removing all of audio object signals from the representative down mixed signal from the SAOC encoder 101 except an object N outputted from the SAC encoder 105 based on Eq. 2, or by removing only the object N from the representative down mixed audio signal based on Eq. 3.

As described above, the SAOC encoder 101 generates sub-band information or supplementary information, which is not limited by the SAC scheme for the high suppression of the signal processor 109. For example, the SAOC encoder 101 may generate spatial cues by analyzing an audio signal by the larger number of sub-band units than 27 which is limited by the SAC scheme. In this case, a sub-band parameter of a spatial cue, which is generated by the SAOC encoder 101 and included in the representative stream, is transformed to be processed by the SAC decoder 111 having only 28 sub-band parameters. Such transformation is performed by the transcoder 107, which will be described in later.

That is, the SAOC encoder 101 for high suppression and the SAC encoder 103 for channel signal restoration according to the present embodiment generate spatial cue information by analyzing a multichannel audio signal composed with multiple channels for each object.

Meanwhile, the audio decoding apparatus according to the present embodiment includes the transcoder 107, the signal processor 109, and the SAC decoder 111. Throughout the specification, the audio decoding apparatus is described to include the transcoder and the signal processor with a decoder. However, it is obvious to those skilled in the art that it is not necessary that the transcoder and the signal processor are physically included in a device with the decoder.

The SAC decoder 111 is a spatial cue based multichannel audio decoder. The SAC decoder 111 restores a multi object audio signal composed with multiple channels by decoding the modified representative down mixed signal outputted from the signal processor 109 to audio signals by objects based on a modified representative bit stream outputted from the transcoder 107.

For example, the SAC decoder 111 may be a MPEG Surround (MPS) decoder, and a BCC decoder.

The signal processor 109 removes a predetermined part of audio objects included in a representative down mixed signal based on a representative down mixed signal outputted from the SAOC encoder 101 and SAOC bit stream information outputted from parsers 301, 601, 707, and 1101, and outputs a modified representative down mixed signal.

For example, the signal processor 109 outputs a modified representative down mixed signal by removing audio object signals from a representative down mixed signal outputted from the SAOC encoder 101 except an object N which is an audio object signal outputted from the SAC encoder 105 by Eq. 2.

$$U^{modified}(f) = U(f) \times \sqrt{\frac{P_b^{Object\#N}}{\sum_{i=1}^{N} P_b^{Object\#i}}} \times \delta \qquad \text{Eq. 2}$$

$$A(b+1) \le f \le A(b+1) - 1$$

In Eq. 2, U(f) denotes a mono channel signal that is transformed from the representative down mixed signal outputted from the SAOC encoder 101 into a frequency domain. $U^{modified}(f)$ is the modified representative down mixed signal which is a signal with remaining objects removed from the representative down mixed signal of the frequency domain except an object N that is an audio object signal outputted from the SAC encoder 105. A(b) denotes a boundary of a frequency domain of a bth sub-band. d is a predetermined constant for controlling a level size and is a value included in a control signal inputted from an external device to the signal processor 109. $P_b^{Object\#1}$ is power of a $b^{th}$ sub-band of an $i^{th}$ object included in a representative down mixed signal outputted from the SAOC encoder 101. An Nth object included in a representative down mixed signal outputted from the SAOC encoder 101 corresponds to an audio object outputted from the SAC encoder 103.

If U(f) is a stereo channel signal, the representative down mixed signal is processed after being divided into a left channel and a right channel.

The modified representative down mixed signal $U^{modified}(f)$ outputted from the signal processor 109 by Eq. 2 corresponds to an object N which is an audio object signal outputted from the SAC encoder 105. That is, the modified representative down mixed signal outputted from the signal processor 109 may be treated as a down mixed signal outputted from the SAC encoder 105 by Eq. 2. Therefore, the SAC decoder 111 restores M multichannel signals from the modified representative down mixed signal.

In this case, the transcoder 107 generates a modified represent bit stream by processing only a SAC bit stream outputted from the SAC encoder 105, which is remaining audio object information excepting a SAOC bit stream outputted from the SAOC encoder 101 from the representative bit stream outputted from the bit stream formatter 105. Therefore, the modified representative bit stream does not include power gain information and correction information, which are directly inputted audio object signals to the SAOC encoder 101.

Here, an overall level of a signal may be controlled by the rendering unit 303 of the transcoder 107 or controlled by a constant d of Eq. 2.

The signal processor 109 outputs a modified representative down mixed signal by removing only an object N which is an audio object signal outputted from the SAC encoder 105 from a representative down mixed signal outputted from the SAOC encoder 101 based on Eq. 3.

$$P \odot W_{oj}^{b} = \underbrace{\begin{bmatrix} p_{1,1}^{b} & p_{1,2}^{b} & \cdots & p_{1,N-1}^{b} \\ p_{2,1}^{b} & p_{2,2}^{b} & \cdots & p_{2,N-1}^{b} \\ \vdots & \vdots & \ddots & \vdots \\ p_{M,1}^{b} & p_{M,2}^{b} & \cdots & p_{M,N-1}^{b} \end{bmatrix}}_{Matrix\ 1} \odot \begin{bmatrix} w_{oj_1}^{b} \\ w_{oj_2}^{b} \\ \vdots \\ w_{oj_N-1}^{b} \end{bmatrix} \qquad \text{Eq. 3}$$

$$= \begin{bmatrix} w_{ch_1}^{b,} \\ w_{ch_2}^{b,} \\ \vdots \\ w_{ch_M}^{b,} \end{bmatrix}_{SAOC}$$

$$w_{oj_j}^{b} = [w_{1,oj_j}^{b}, \cdots, w_{m,oj_j}^{b}]^{T}$$

(stereo: $m = 2$, mono: $m = 1$)

$$U^{modified}(f) = U(f) \times \sqrt{\frac{\sum_{i=1}^{N-1} P_b^{Object\#i}}{\sum_{i=1}^{N} P_b^{Object\#i}}} \times \delta$$

$$A(b+1) \le f \le A(b+1) - 1$$

In Eq. 3, the modified representative down mixed signal $U^{modified}(f)$ outputted from the signal processor 109 based on Eq. 3 is a signal except an object N from the representative down mixed signal U(f) outputted from the SAOC encoder 101. The object N is an audio object signal outputted from the SAC encoder 105.

In this case, the transcoder 107 generates a modified representative bit stream by processing only audio object information remaining except a SAC bit stream outputted from the SAC encoder 105 from a representative bit stream outputted from the bit stream formatter 105. Therefore, power gain information and correlation information are not included in the modified representative bit stream. Here, the power gain information and correlation information correspond to the object N, an audio object signal outputted from the SAC encoder 105.

Here, the overall level of signal is controlled by the rendering unit 303 of the transcoder 107 or controlled by a constant d of Eq. 3.

It is obvious that the signal processor 109 can process not only the frequency domain signal but also a time domain signal. The signal processor 109 may use Discrete Fourier Transform (DFT) or Quadrature Mirror Filterbank (QMF) to divide the representative down mixed signal by sub-bands.

The transcoder 107 performs rendering on an audio object transferred from the SAOC encoder 101 to the SAC decoder 111 and transfers the representative bit stream generated from the bit stream formatter 105 based on object control information and reproducing system information, which are a control signal inputted from an external device.

The transcoder 107 generates rendering information based on a representative bit stream outputted from the bit stream formatter 105 in order to transform an audio object transferred from the SAC decoder 111 to a multi object audio signal composed with multichannel. The transcoder 107 renders an audio object transferred from the SAC decoder 111 corresponding to a target audio scene based on audio object information included in the representative bit stream. In the rendering process, the transcoder 107 predicts spatial information corresponding to the target audio scene and generates additional information of the modified representative bit stream by transforming the predicted spatial information.

Also, the transcoder 107 transforms the representative bit stream outputted from the bit stream formatter 105 into a bit stream to be processable by the SAC decoder 111.

The transcoder 107 excludes information corresponding objects removed by the signal processor 109 from the representative bit stream outputted from the bit stream formatter 105.

Figure 3:
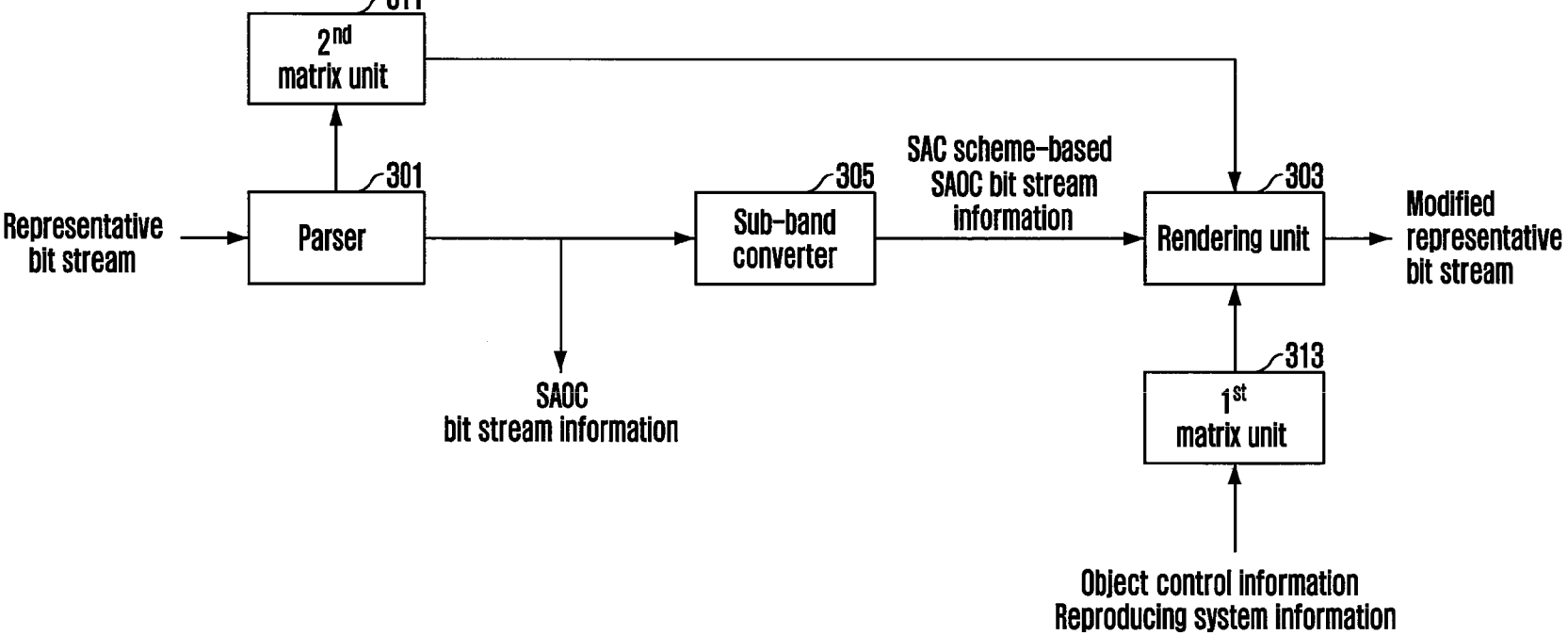
FIG. 3 is a diagram illustrating a transcoder f FIG. 2.

FIG. 3 is a diagram illustrating a transcoder 107 of FIG. 2.

As shown in FIG. 3, the transcoder 107 includes a parser 301, a rendering unit 303, a sub-band converter 305, a second matrix unit 311, and a first matrix unit 313.

The parser 301 separates the SAOC bit stream generated by the SAOC encoder 101 and the SAC bit stream generated by the SAC encoder 103 from the representative bit stream by parsing the representative bit stream outputted from the bit stream formatter 105. The parser 301 also extracts information about the number of audio objects inputted to the SAOC encoder 101 from the separated SAOC bit stream.

The second matrix unit 311 generates a second matrix II based on the separated SAC bit stream from the parser 301. The second matrix is a matrix for an input signal of the SAC encoder 103, which is a multichannel audio signal. The second matrix is about a power gain value of the multichannel audio signal which is an input signal of the SAC encoder 103. Eq. 4 shows the second matrix II.

$$\underbrace{\begin{bmatrix} w^b_{ch_1} \\ w^b_{ch_2} \\ \vdots \\ w^b_{ch_M} \end{bmatrix}_{SAC}}_{Matrix\ II} [u^b_{SAC}(k)] = [Y^b_{SAC}(k)] = \begin{bmatrix} y^b_{ch_1}(k) \\ y^b_{ch_2}(k) \\ \vdots \\ h^b_{ch_M}(k) \end{bmatrix} \quad \text{Eq. 4}$$

Basically, one audio signal frame is analyzed into M sub-band units according to the SAC technology. Here, $u_{SAC}{}^b(k)$ denotes an object N, an audio object signal outputted from the SAC encoder 105, which is a down-mixed signal outputted from the SAC encoder 103. k is frequency coefficient. b is an sub-band index. $w_{ch_i}{}^b$ is spatial cue information of M input audio signals of the SAC encoder 103, which is a multichannel signal included in the SAC bit stream. It is used to restore frequency information of $i^{th}$ audio signal where i is an integer greater than 1 and smaller than M ($1 \le i \le M$). Therefore, $w_{ch_i}{}^b$ may be expressed as a size or a phase of a frequency coefficient. Therefore, $Y_{SAC}{}^b(k)$ of Eq. 4 denotes a multichannel audio signal outputted from the SAC decoder 111.

$u_{SAC}{}^b(k)$ and $w_{ch_i}{}^b$ are vectors. A Transpose Matrix Dimension of $u_{SAC}{}^b(k)$ becomes the dimension of $w_{ch_i}{}^b$. For example, it can be defined like Eq. 5. Here, since the object N is a mono channel signal or a stereo channel signal, m may be 1 or 2. As described above, the object N is a down-mixed signal outputted from the SAC encoder 103 and also is audio object signal outputted from the SAC encoder 105.

$$w^b_{ch_1} \times u^b_{SAC}(k) = [\, w^b_1 \quad w^b_2 \quad \ldots \quad w^b_m \,] \begin{bmatrix} u^b_1(k) \\ u^b_2(k) \\ \vdots \\ u^b_m(k) \end{bmatrix} \quad \text{Eq. 5}$$

As described above, $w_{ch_i}{}^b$ is spatial cue information included in a SAC bit stream.

If $w_{ch_i}{}^b$ denotes a power gain at a sub-band of each channel, $w_{ch_i}{}^b$ may be predictable by CLD. If $w_{ch_i}{}^b$ is used to correct a phase difference between frequency coefficients, $w_{ch_i}{}^b$ may be predicted by CTD or ICC.

Hereinafter, $w_{ch_i}{}^b$ is exemplarily used as coefficient to correct a phase difference of frequency coefficients.

In order to generates a multichannel audio signal $Y_{SAC}{}^b(k)$ outputted from the SAC decoder 111 through matrix calculation with the down mixed signal outputted from the SAC encoder 103, which is the object N, audio object signal outputted from the SAC encoder 105, the second matrix II of Eq. 4 expresses a power gain value of each channel and has a reverse dimension of the down mixed signal which is an object N that is an audio object signal outputted from the SAC encoder 105.

The rending unit 303 combines a second matrix II of Eq. 4, which is generated by the second matrix unit 311, with the output of the first matrix unit 313.

The first matrix unit 313 generates a first matrix I based on a control signal inputted an external device in order to map an audio object from the SAC decode 11 to a multi object audio signal including multiple channels. An elementary vector $p_{i,j}{}^b$ forming the first matrix I of Eq. 6 denotes power gain information or phase information for mapping jth audio objects to an ith output channel of the SAC decoder 111 where j is an integer greater than 1 and smaller than (N−1) ($1 \le j \le N-1$) and i is an integer greater than 1 and smaller than M ($1 \le i \le M$). The elementary vector $p_{i,j}^{b}$ can be inputted from an external device or obtained from control information set with initial value, for example from object control information and reproducing system information.

The first matrix I of Eq. 6 generated by the first matrix unit 313 is calculated based on Eq. 6 by the rendering unit 303. In N input audio objects of the SAOC encoder 101, a Nth audio object is a down mixed signal outputted from the SAC encoder 103 and remaining signals are directly inputted to the SAOC encoder 101. In this case, each of audio objects except a down mixed signal outputted from the SAC encoder 103 may be mapped to M output channels of the SAC decode according to the first matrix I. Here, the down mixed signal is an object N which is an audio object signal outputted from the SAC encoder 105. The rendering unit 303 calculates a matrix including a power gain vector $w_{ch_i}^{b}$ of an output channel of the SAC decoder 111 based on Eq. 6.

$$P \odot W_{oj}^{b} = \underbrace{\begin{bmatrix} p_{1,1}^{b} & p_{1,2}^{b} & \cdots & p_{1,N-1}^{b} \\ p_{2,1}^{b} & p_{2,2}^{b} & \cdots & p_{2,N-1}^{b} \\ \vdots & \vdots & \ddots & \vdots \\ p_{M,1}^{b} & p_{M,2}^{b} & \cdots & p_{M,N-1}^{b} \end{bmatrix}}_{Matrix\ I} \odot \begin{bmatrix} w_{oj_1}^{b} \\ w_{oj_2}^{b} \\ \vdots \\ w_{oj_N-1}^{b} \end{bmatrix} = \begin{bmatrix} w_{ch_1}^{b} \\ w_{ch_2}^{b} \\ \vdots \\ w_{ch_M}^{b} \end{bmatrix}_{SAOC} \quad \text{Eq. 6}$$

$$w_{oj_j}^{b} = [w_{1,oj_j}^{b}, \cdots, w_{m,oj_j}^{b}]^{T}$$

(stereo: $m = 2$, mono: $m = 1$)

In Eq. 6, $w_{ch_i}^{b}$ is a vector denoting a jth ($1 \le j \le N-1$) audio object excepting audio objects outputted from the SAC encoder 105, for example, a sub-band signal of an audio object directly inputted to the SAOC encoder 101 of FIG. 1. That is, it is spatial cue information that can be obtained from a SAOC bit stream according to a SAC scheme, which is a SAOC bit stream outputted from the sub-band converter 305. If the $j^{th}$ audio object is stereo, corresponding spatial cue $w_{ch_i}^{b}$ has a 2×1 dimension.

An operator ⊙ of Eq. 6 is equivalent to Eq. 7 and Eq. 8.

$$[p_{1,1}^{b} \quad p_{1,2}^{b} \quad \cdots \quad p_{1,N-1}^{b}] \odot \begin{bmatrix} w_{oj_1}^{b} \\ w_{oj_2}^{b} \\ \vdots \\ w_{oj_(N-1)}^{b} \end{bmatrix} = [p_{1,1}^{b} \odot w_{oj_1}^{b} + p_{1,2}^{b} \odot w_{oj_2}^{b} \ldots + p_{1,N-1}^{b} \odot w_{oj_(N-1)}^{b}] \quad \text{Eq. 7}$$

$$p_{i,j}^{b} \odot w_{oj_i}^{b} = [p_{1,i,j}^{b} \quad p_{2,i,j}^{b} \quad \cdots \quad p_{m,i,j}^{b}] \odot \begin{bmatrix} w_{1,oj_j}^{b} \\ w_{2,oj_j}^{b} \\ \vdots \\ w_{m,oj_j}^{b} \end{bmatrix} = [p_{1,i,j}^{b} \times w_{1,oj_j}^{b} \quad p_{2,i,j}^{b} \times w_{2,oj_j}^{b} \quad \cdots \quad p_{m,i,j}^{b} \times w_{m,oj_j}^{b}] \quad \text{Eq. 8}$$

In Eq. 7 and Eq. 8, since an audio object transferred to the SAC decoder 111 is a mono channel signal or a stereo channel signal, m may be 1 or 2. Except audio outputs outputted from the SAC encoder 105 among input signals of the SAOC encoder 101, the number of input audio objects is N−1. If the input audio object is a stereo channel signal and if the M output channels are outputted from the SAC decoder 111, the dimension of the first matrix of Eq. 6 is M×(N−1) and $p_{i,j}^{b}$ is composed as a 2×1 matrix.

Then, the rendering unit 303 calculates target spatial cue information based on a matrix including power gain vectors $w_{ch_i}^{b}$ of an output channel as a second matrix II calculated by Eq. 4 and a matrix calculated by Eq. 6 and generates a modified representative bit stream including the target spatial cue information. Here, the target spatial cue is a spatial cue related to an output multichannel audio signal intended to be outputted from the SAC decoder 111. That is, the rendering unit 303 calculates the desired spatial cue information $w_{modified}^{b}$ according to Eq. 9. Therefore, a power ratio of each channel may be expressed as $w_{modified}^{b}$ after rendering an audio object transferred to the SAC decoder 111.

$$pow(p_N) \begin{bmatrix} w_{ch_1}^{b} \\ w_{ch_2}^{b} \\ \vdots \\ w_{ch_M}^{b} \end{bmatrix}_{SAC} + (1 - pow(p_N)) \begin{bmatrix} w_{ch_1}^{b} \\ w_{ch_2}^{b} \\ \vdots \\ w_{ch_M}^{b} \end{bmatrix}_{SAOC} = \begin{bmatrix} w_{ch_1}^{b} \\ w_{ch_2}^{b} \\ \vdots \\ w_{ch_M}^{b} \end{bmatrix} = W_{modified}^{b} \quad \text{Eq. 9}$$

In Eq. 9, $p_N$ is a ratio of power of an object N which is an audio object signal outputted from the SAC encoder 105 and a sum of power of (N−1) audio objects directly inputted to the SAOC encoder 101. It is defined as Eq. 10.

$$p_N = \frac{\sum_{k=N-1} \text{power(object \# } k)}{\text{power(object \# } N)} \quad \text{Eq. 10}$$

A power ratio of signals transferred and outputted to the SAC decoder 111 may be expressed as CLD which is a spatial cue parameter. The spatial cue parameter between adjacent channel signals may be expressed as various combinations from the spatial cue information $w_{modified}^{b}$. That is, the rendering unit 303 generates the spatial cue parameter from the spatial cue information $w_{modified}^{b}$.

For example, if an audio signal transferred from the SAC decoder 111 is a stereo channel signal, the CLD parameter between the first channel signal Ch1 and the second channel signal Ch2 may be generated based on Eq. 11.

$$CLD_{ch1/ch2}^{b} = 20\log_{10}\frac{w_{ch1}^{b}}{w_{ch2}^{b}} = \left[20\log_{10}\frac{w_{ch1,1}^{b}}{w_{ch2,1}^{b}}, 20\log_{10}\frac{w_{ch1,2}^{b}}{w_{ch2,2}^{b}}\right]_{m=2} \quad \text{Eq. 11}$$

Meanwhile, if an audio signal transferred to the SAC decoder 111 is a mono channel signal, a CLD parameter can be calculated by Eq. 12.

$$CLD^{b}_{ch1/ch2} = 10\log_{10}\frac{(w^{b}_{ch1,1})^2 + (w^{b}_{ch1,2})^2}{(w^{b}_{ch2,1})^2 + (w^{b}_{ch2,2})^2} \quad \text{Eq. 12}$$

The rendering unit 303 generates a modified represent bit stream according to Huffman coding based on spatial cue parameters extracted from $w_{modified}^{b}$, for example CLD parameters of Eq. 11 and Eq. 12.

A spatial cue included in the modified representative bit stream generated by the rendering unit 303 is differently analyzed and extracted according to characteristics of a decoder. For example, a BCC decoder can extract (N−1) CLD parameters for on one channel using Eq. 11. Also, the MPEG Surround decoder can extract CLD parameters based on a comparison order of each channel of MPEG Surround.

That is, the parser 301 separates a SAOC bit stream generated by the SAOC encoder 101 and a SAC bit stream generated by the SAC encoder 103 from a representative bit stream outputted from the bit stream formatter 105. The second matrix unit 311 generates a second matrix II using Eq. 4 based on the separated SAC bit stream. The first matrix unit 313 generates a first matrix I corresponding to a control signal. The rendering unit 303 calculates a matrix including power gain vectors $w_{ch_i}^{b}$ of the SAC decoder 111 using Eq. 6 based on the first matrix and the separated SAOC bit stream which is a SAOC bit stream converted by the sub-band converter 305, that is, a SAOC bit stream according to a SAC scheme. The rendering unit 303 calculates spatial cue information $w_{modified}^{b}$ using Eq. 9 based on the matrix calculated by Eq. 6 and the second matrix calculated by Eq. 4. The rendering unit 303 generates a modified representative bit stream based on the spatial cue parameters extracted from the $w_{modified}^{b}$, for example, CLD parameters of Eq. 11 and Eq. 12. The modified representative bit stream is a bit stream properly converted according to the characteristics of a decoder. The modified representative bit stream can be restored as a multi object audio signal including multiple channels.

As described above, the SAOC encoder 101 can generate spatial cues for further more sub-bands regardless of a SAC scheme that the SAC encoder 103 and the SAC decoder 111 are dependent to. That is, the SAOC encoder 101 generates spatial cues for sub-bands of further higher resolution and supplementary spatial cue. For example, the SAOC encoder 101 can generate spatial cues for sub-bands more than 28 sub-bands which is the number of sub-bands limited by the MPEG Surround scheme of the SAC encoder 103 and the SAC decoder 111.

When the SAOC encoder 101 generates a spatial cue parameter as a supplementary sub-band unit, which is larger than the number of sub-bands limited by the SAC scheme, the transcoder 107 transforms a spatial cue parameter corresponding to the additional sub-band to be corresponding to a sub band limited by the SAC scheme. Such transformation is performed by the sub-band converter 305.

Figure 4:
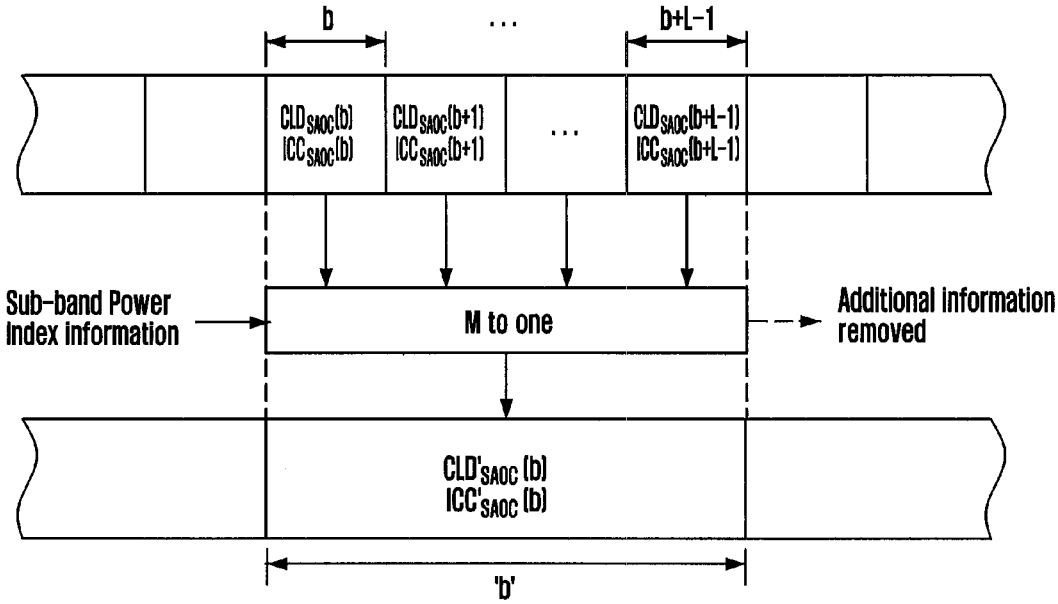
FIG. 4 is a conceptual view showing a process for converting a spatial cue parameter corresponding to the additional sub-band into a sub-band limited by a SAC scheme.

FIG. 4 is a diagram illustrating a process of converting a spatial cue parameter corresponding to the additional sub-band to a sub-band limited by a SAC scheme, which is performed by the sub-band converter 305.

If a $b^{th}$ sub-band among sub-bands limited by the SAC scheme has correspondent relation with L additional sub-bands of the SAOC encoder 101, the sub-band converter 305 converts spatial cue parameters for the L additional sub-bands into one spatial cue parameter and maps it to the $b^{th}$ sub-band. As an example of converting the spatial cue parameters for the L additional sub-bands into one spatial cue parameter, the sub-band converter 305 converts CLD parameters for the L additional sub-bands extracted from a SAOC bit stream by the SAOC encoder 101 to one CLD parameter. In this case, the sub-band converter 305 selects a CLD parameter of a sub-band having the most dominant power from the L additional sub-bands and maps the selected CLD parameter to the $b^{th}$ sub-band limited by the SAC scheme. The SAOC encoder 101 calculates an index Pw_indx(b) of the sub-band having the most dominant power using Eq. 13 and includes the calculated index into the SAOC bit stream.

$$\text{Pw_indx}(b) = \underset{d}{\operatorname{argmin}}\begin{bmatrix} \text{CLD_dist}(b) \\ \vdots \\ \text{CLD_dist}(b+d) \\ \vdots \\ \text{CLD_dist}(b+L-1) \end{bmatrix} \quad \text{Eq. 13}$$

$$\begin{bmatrix} \text{CLD_dist}(b) \\ \vdots \\ \text{CLD_dist}(b+d) \\ \vdots \\ \text{CLD_dist}(b+L-1) \end{bmatrix} = CLD'_{SAC}(b) - \begin{bmatrix} CLD_{SAOC}(b) \\ \vdots \\ CLD_{SAOC}(b+d) \\ \vdots \\ CLD_{SAOC}(b+L-1) \end{bmatrix}$$

In Eq. 13, $CLD'_{SAC}(b)$ is CLD information for a $b^{th}$ SAC sub-band period, which is sub-band information generated according to the SAC scheme by the SAOC encoder 101 in order to calculate the sub-band index Pw_indx(b). $CLD_{SAOC}(b+d)$ is a CLD value related to a $d^{th}$ subordinate sub-band among SAOC subordinate sub-bands, that is the L additional sub-bands corresponding to the $b^{th}$ SAC sub-band period, where $0 \le d \le L-1$. The subordinate sub-band for the L SAOC sub-bands is to identify a plurality of SAOC sub-bands corresponding one SAC sub-band period, that is, a sub-band of high resolution. If an analysis unit of the SAC sub-band is identical to that of the SAOC sub-band, $CLD_{SAOC}(b)=CLD_{SAC}(b)$. CLD_dist(b+d) denotes a difference between $CLD'_{SAC}(b)$ and $CLD_{SAOC}(b+d)$. Therefore, a sub band index Pw_indx(b) is an index of a CLD value having the smallest difference with $CLD'_{SAC}(b)$ among the L additional sub bands.

The sub-band converter 305 maps a CLD value $CLD_{SAOC}$(Pw_indx(b)) having the smallest difference with $CLD'_{SAC}(b)$ among the L additional sub-bands to the $b^{th}$ sub-band of the SAOC bit stream according to Eq. 14 based on a sub-band index Pw_indx(b) that is generated by the SAOC encoder 101 for a SAOC bit stream outputted from the parser 301. That is, a CLD parameter $CLD'_{SAOC}(b)$ for the $b^{th}$ sub-band of the SAOC bit stream is replaced with a CLD value having the smallest difference with $CLD'_{SAC}(b)$ among the L supplementary sub-bands according to Eq. 14.

$$CLD'_{SAOC}(b)=CLD_{SAOC}(Pw_indx(b)) \quad \text{Eq. 14}$$

Meanwhile, if a difference between an arithmetic mean of $[CLD_{SAOC}(b), \ldots, CLD_{SAOC}(b+L)]^T$ and $CLD_{SAOC}$(Pw_indx(b)) is greater than 10 dB, $CLD'_{SAOC}(b)$ of Eq. 14 is replaced with a value smoothened by Eq. 15. The largest deviation between $CLD'_{SAOC}(b)$ and $[CLD_{SAOC}(b), \ldots, CLD_{SAOC}(b+L)]^T$ is excluded by Eq. 15.

$$CLD'_{SAOC}(b) = \frac{1}{2a+1}\sum_{j=-a}^{+a} CLD_{SAOC}(\text{Pw_indx}(b)+j) \quad \text{Eq. 15}$$

$$0 \le a \le L/2$$

In order to exclude the largest deviation between $CLD'_{SAOC}(b)$ and $[CLD_{SAOC}(b), \ldots, CLD_{SAOC}(b+L)]^T$, CLDs having more than ±30 dB are excluded from Eq. 15 among CLDs $[CLD_{SAOC}(b-L/2), \ldots, CLD_{SAOC}(b+L/2)]^T$ for the L supplementary sub-bands. A sub-band channel signal having a CLD higher than ±30 dB may be ignored because it is very small signal. For example, if $[CLD_{SAOC}(b), \ldots, CLD_{SAOC}(b+L)]^T$ is $[\ldots, -10, 5, -32, \ldots]^T$, L/2=1, and $CLD_{SAOC}(Pw_indx(b))=5$, $$CLD'_{SAOC}(b) = \frac{1}{3}(-10+5-32).$$

However, if values higher than ±30 dB are excluded, $$CLD'_{SAOC}(b) = \frac{1}{2}(-10+5).$$

Meanwhile, the sub-band converter 305 calculates an index Pw_indx(b) of a sub-band using Eq. 16 instead of an index Pw_indx(b) of a sub-band generated based on Eq. 13 by the SAOC encoder 101 and exchanges a CLD parameter $CLD'_{SAOC}(b)$ of the bth sub-band of the SAOC bit stream with $CLD_{SAOC}(Pw_indx(b))$ according to Eq. 14 and Eq. 15.

$$Pw_indx(b) = \underset{d}{\operatorname{argmin}}\left\{\left\|0\ \text{dB} - \begin{bmatrix} CLD_{SAOC}(b) \\ \vdots \\ CLD_{SAOC}(b+d) \\ \vdots \\ CLD_{SAOC}(b+L-1) \end{bmatrix}\right\|\right\} \quad \text{Eq. 16}$$

Although the CLD was exemplarily described, another spatial cue parameter ICC may be identically applied according to the present embodiment. For example, an ICC parameter $ICC'_{SAOC}(b)$ of the $b^{th}$ sub-band of the SAOC bit stream is replaced with $ICC_{SAOC}(Pw_indx(b))$ according to Eq. 17 to Eq. 20.

$$Pw_indx(b) = \underset{d}{\operatorname{argmin}}\begin{bmatrix} ICC_dist(b) \\ \vdots \\ ICC_dist(b+d) \\ \vdots \\ ICC_dist(b+L-1) \end{bmatrix} \quad \text{Eq. 17}$$

$$\begin{bmatrix} ICC_dist(b) \\ \vdots \\ ICC_dist(b+d) \\ \vdots \\ ICC_dist(b+L-1) \end{bmatrix} = ICC'_{SAC}(b) - \begin{bmatrix} ICC_{SAOC}(b) \\ \vdots \\ ICC_{SAOC}(b+d) \\ \vdots \\ ICC_{SAOC}(b+L-1) \end{bmatrix}$$

$$ICC'_{SAOC}(b) = ICC_{SAOC}(Pw_indx(b)) \quad \text{Eq. 18}$$

$$ICC'_{SAOC}(b) = \frac{1}{2a+1}\sum_{j=-a}^{+a} ICC_{SAOC}(Pw_indx(b)+j) \quad \text{Eq. 19}$$

$$0 \le a \le L/2$$

-continued $$Pw_indx(b) = \underset{d}{\operatorname{argmin}}\left\{\left\|0\ \text{dB} - \begin{bmatrix} ICC_{SAOC}(b) \\ \vdots \\ ICC_{SAOC}(b+d) \\ \vdots \\ ICC_{SAOC}(b+L-1) \end{bmatrix}\right\|\right\} \quad \text{Eq. 20}$$

As described above, the sub-band converter 305 converts a SAOC bit stream outputted from the parser 301 to a SAOC bit stream according to a SAC scheme. Here, the SAOC bit stream includes spatial cue parameters generated by a supplementary sub-band unit which is a unit of sub-bands more than the number of sub-bands limited based on the SAC scheme. The rendering unit 303 calculates a matrix including a power gain vector $w_{ch_i}^{\ b}$ of an output channel of the SAC decoder 111 according to Eq. 6 based on the first matrix I and the converted SAOC bit stream from the sub-band converter 305, that is, the SAOC bit stream according to the SAC scheme.

Hereinbefore, it was described that the supplementary sub-band unit is a sub-band unit larger than the number of sub-bands limited by the SAC scheme, and that the SAOC encoder 101 generates the spatial cue parameters by the supplementary sub-band unit and includes the generates spatial cue parameters in the SAOC bit stream. However, the technical aspect of the present invention may be identically applied although unused spatial cue information is additionally included in a SAOC bit stream.

For example, the SAOC encoder 101 generates spatial cue information such as Interaural Phase Difference (IPD) and Overall Phase Difference (OPD) as phase information and includes the generated spatial cue information in the SAOC bit stream for high suppression of the signal processor 109. The supplementary information may improve decomposition capability of audio objects. Therefore, the signal processor 109 can delicately and clearly remove audio objects from a representative down mixed signal. Here, IPD means a phase difference between two input audio signals at a sub-band, and OPD denotes a sub band phase difference between a representative down mix signal and an input audio signal.

Meanwhile, the sub-band converter 305 removes the additional information for generating a SAOC bit stream according to a SAC scheme.

Figure 12:
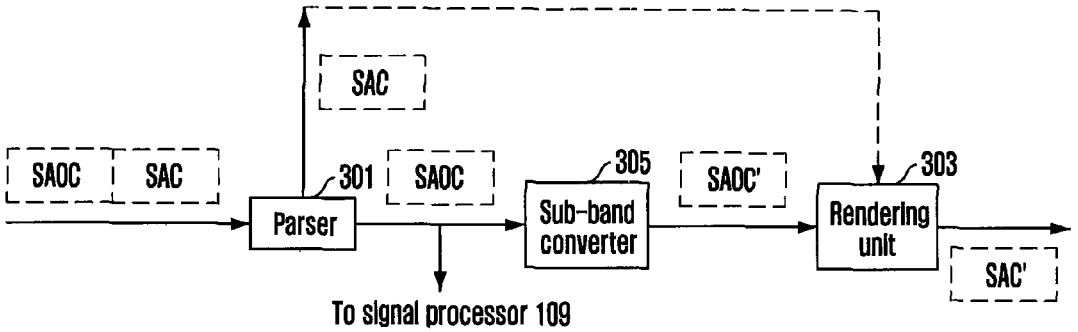
FIG. 12 is a diagram illustrating a transcoder shown in FIG. 3, which shows a process of processing a representative bit stream including sub-band information not limited by a SAC scheme or additional information.

FIG. 12 is a diagram illustrating a transcoder shown in FIG. 3. That is, FIG. 12 is a conceptual diagram illustrating a process of processing a representative bit stream having sub-band information not limited by a SAC scheme or additional information at the transcoder 107. For convenience, the first matrix unit 313 and the second matrix unit 311 are not shown in FIG. 12.

As shown in FIG. 12, a representative bit stream inputted to the parser 301 includes a SAOC bit stream generated by the SAOC encoder 101. The SAOC bit stream generated by the SAOC encoder 101 is additional spatial cue information including spatial cue information not limited by a SAC scheme such as a sub-band index Pw_indx(b), ITD, and etc. The parser 301 outputs a SAC bit stream generated by the SAC encoder 103 from the representative bit stream to the second matrix unit 311. Also, the parser 301 outputs a SAOC bit stream generated by the SAOC encoder 101 to the sub-band converter 305. The sub-band converter 305 converts the generated SAOC bit steam from the SAOC encoder 101 to a SAC scheme based SAOC bit stream and outputs the SAOC bit stream to the rendering unit 303. Therefore, since a modified representative bit stream outputted from the rendering unit 303 is a SAC scheme based bit stream, the SAC decoder 111 can process the modified representative bit stream.

Figure 5:
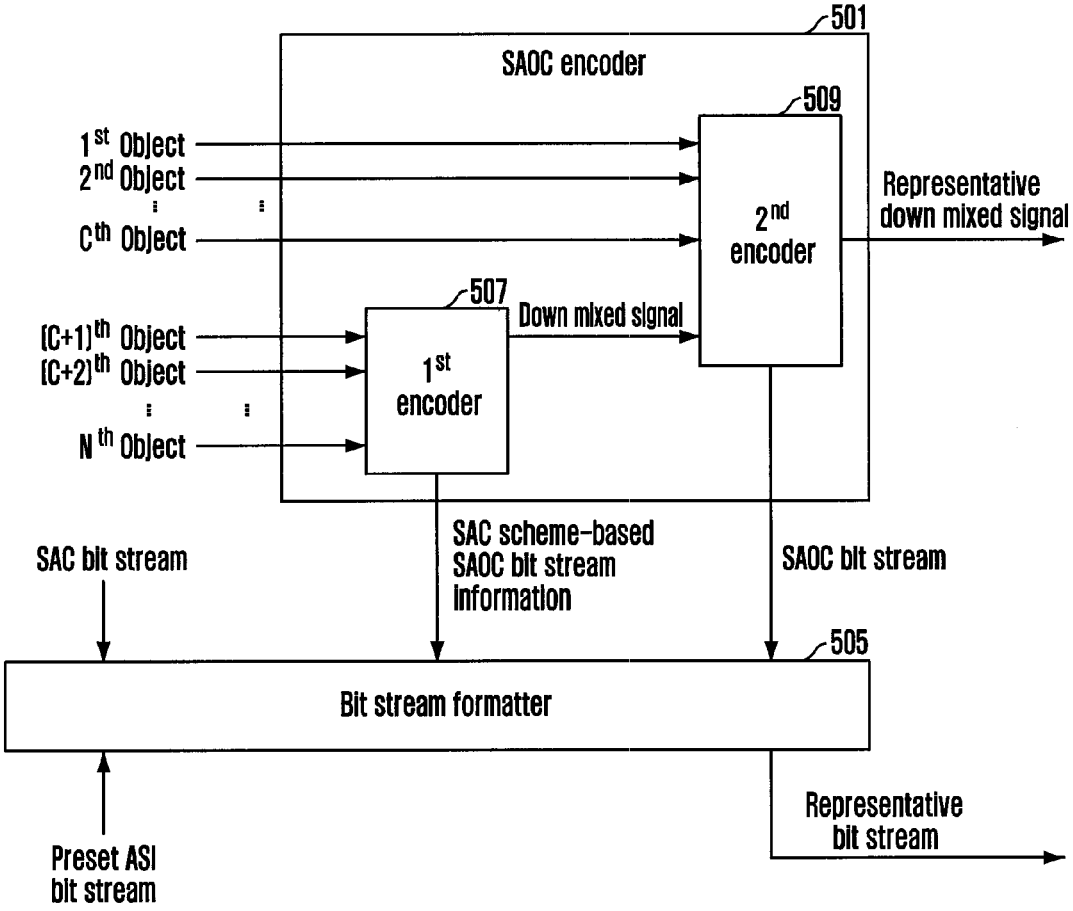
FIG. 5 is a diagram illustrating a SAOC encoder and a bit stream formatter in accordance with another embodiment of the present invention.

FIG. 5 is a diagram illustrating a SAOC encoder and a bit stream formatter in accordance with another embodiment of the present invention.

The SAOC encoder 101 and the bit stream formatter 105 shown in FIG. 1 may be replaced with the SAOC encoder 501 and the bit stream formatter 505 shown in FIG. 1. In this case, the SAOC encoder 501 generates two SAOC bit streams. One is a SAOC bit stream not limited by a SAC scheme, and the other is a SAOC bit stream limited by the SAC scheme, which is referred as a SAC scheme based SAOC bit stream. The SAOC bit stream not limited by the SAC scheme includes spatial cue information not limited by the SAC scheme, such as a sub-band index Pw_indx(b), ITD, and etc like the SAOC bit stream outputted from the SAOC encoder 101 of FIG. 1.

The SAOC encoder 501 includes a first encoder 507 and a second encoder 509. The first encoder 507 down-mixes [N-C] audio objects among N audio objects inputted to the SAOC encoder 501. The first encoder 507 also generates the SAC scheme based SAOC bit stream as SAOC bit stream information including spatial cue information for the [N-C] audio objects and supplementary information. The second encoder 509 generates the representative down-mixed signal by down-mixing the down mixed signal outputted from the first encoder 507 and remaining C audio objects among the N audio objects inputted to the SAOC encoder 501. The second encoder 509 also generates a SAOC bit stream not limited by the SAC scheme as a SAOC bit stream including spatial cue information and supplementary information for the remaining C audio objects and the down-mixed signal outputted from the first encoder 507.

The bit stream formatter 505 generates a representative bit stream by combining the two SAOC bit streams outputted from the SAOC encoder 101, the SAC bit stream outputted from the SAC encoder 103, and the Preset-ASI bit stream outputted from the Preset-ASI unit 113. The representative bit stream outputted from the bit stream formatter 505 may be one of bit streams shown in FIGS. 2 and 10.

Figure 6:
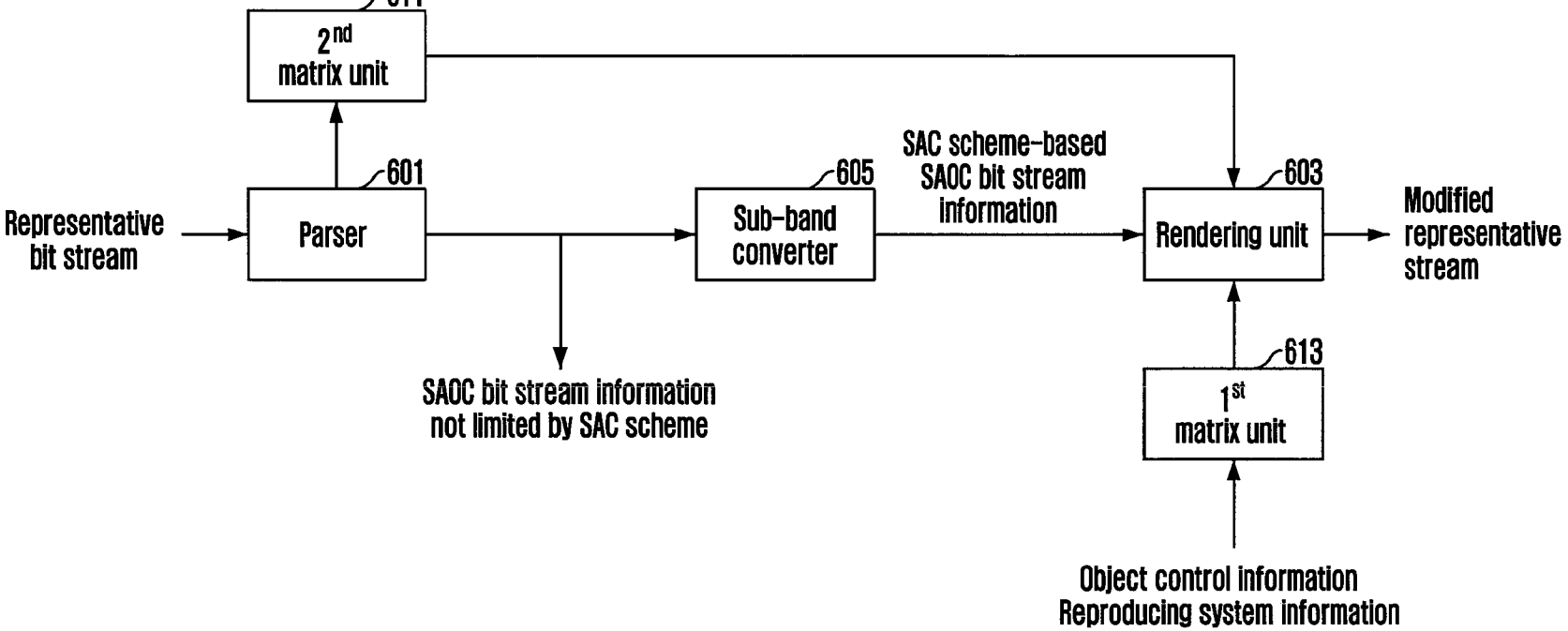
FIG. 6 is a diagram illustrating a transcoder in accordance with another embodiment of the present invention, which is suitable for the SAOC encoder 501 and the bit stream formatter 505 shown in FIG. 5.

FIG. 6 is a diagram illustrating a transcoder in accordance with another embodiment of the present invention, which is suitable for the SAOC encoder 501 and the bit stream formatter 505 shown in FIG. 5.

The transcoder of FIG. 6 basically performs the same operations of the transcoder of FIG. 3. However, the parser 601 separates two SAOC bit streams generated by the SAOC encoder 501 from the representative bit stream outputted from the bit stream formatter 105. One is a SAOC bit stream not limited by a SAC scheme, and the other is a SAOC bit stream limited by the SAC scheme which is referred as the SAC scheme based SAOC bit stream. The SAC scheme based SAOC stream is directly used by the rendering unit 603. Meanwhile, the SAOC bit stream not limited by the SAC scheme is used in the signal processor 109 and is converted into the SAC scheme based SAOC stream by the sub-band converter 605.

As described above, the SAOC bit stream not limited by the SAC scheme is information generated by the SAOC encoder 501 and includes sub-band information not limited by the SAC scheme or additional information. The additional information improves capability of decomposing audio objects. Therefore, the signal processor 109 may delicately and clearly remove audio objects from a representative down mixed signal. That is, since audio objects for the sub-band information not limited by the SAC scheme or the additional information include further more supplementary information, high suppression can be archived by the signal processor 109.

Meanwhile, the SAOC bit stream not limited by the SAC scheme is converted by the sub-band converter 605 in order to enable the SAC decoder 111, for example, having 28 sub-band parameters, to process the SAOC bit stream according to the SAC scheme. For example, the additional information is removed by the sub-band converter 605 for generating the SAC scheme based SAOC stream.

Figure 11:
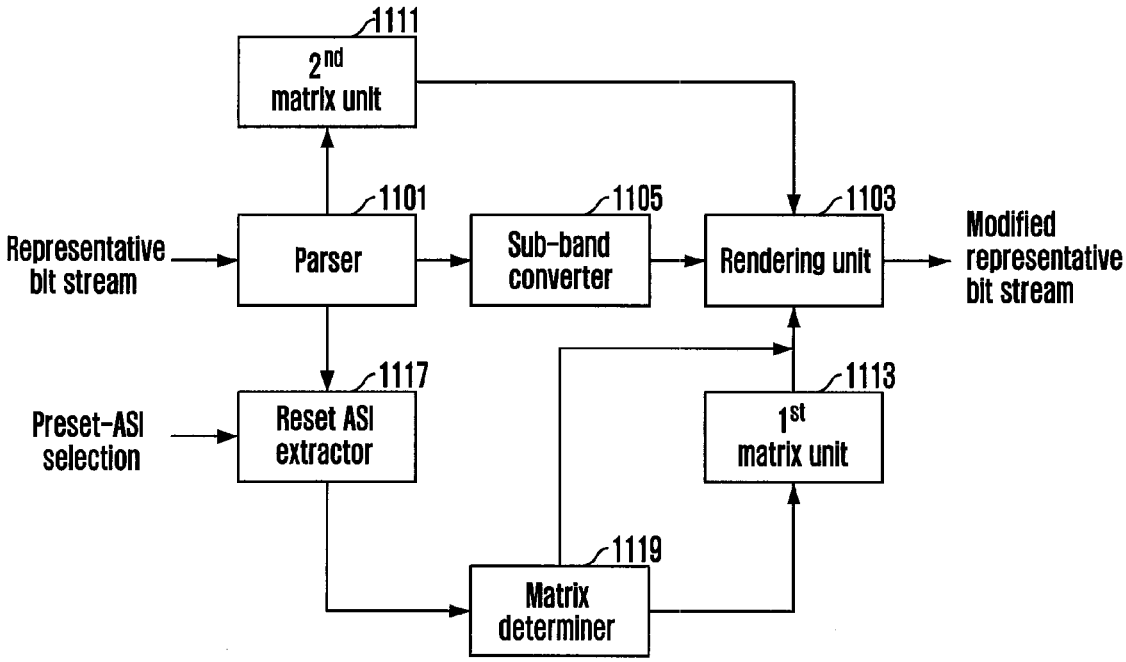
FIG. 11 is a diagram illustrating a transcoder in accordance with another embodiment of the present invention.

FIG. 11 is a diagram illustrating a transcoder in accordance with another embodiment of the present invention. The transcoder of FIG. 11 uses Preset-ASI information instead of object control information and reproducing system information which are directly inputted to the first matrix unit.

The transcoder of FIG. 11 includes a rendering unit 1103, a sub-band converter 1105, a second matrix unit 1111, and a first matrix unit 1113. These constituent elements of the transcoder of FIG. 11 perform the same operations of the rendering units 303 and 603, the sub-band converters 305 and 605, the second matrix units 311 and 611, and the first matrix units 313 and 613 shown in FIGS. 3 and 6.

However, a representative bit stream inputted to the parser 1101 additionally includes a Preset-ASI bit stream shown in FIG. 10. The parser 1101 separates the SAOC bit stream generated by the SAOC encoders 101 and 501 and the SAC bit stream generated by the SAC encoder 103 from the representative bit stream by parsing the representative bit stream outputted from the bit stream formatter 105 and 505. The parser 1101 also parses the Preset-ASI bit stream from the representative bit stream and transmits the Preset-ASI bit stream to a Preset-ASI extractor 1117.

The Preset-ASI extractor 1117 extracts default Preset-ASI information from the extracted Preset-ASI bit stream from the parser 1101. That is, the Preset-ASI extractor 1117 extracts scene information for a basic output. The Preset-ASI extractor 1117 may extract Preset-ASI information which is selected and requested by the Preset-ASI bit stream extracted from the parser 1101 in response to a Preset-ASI selection request inputted from an external device.

A matrix determiner 1119 determines whether the selected Preset-ASI information is a form of the first matrix I or not if the extracted Preset-ASI information from the Preset-ASI extractor 1117 is the Preset-ASI information selected based on the Preset-ASI selection request. If the selected Preset-ASI information is not the form of the first matrix I, that is, if the selected Preset-ASI information directly expresses information on a location and a level of each audio object and information on an output layout, the matrix determiner 1119 transmits the selected Preset-ASI information to the first matrix unit 1113 and the first matrix unit 1113 generates the first matrix I using the Preset-ASI information transmitted from the matrix determiner 1119. If the selected Preset-ASI information is the form of the first matrix I, the matrix determiner 1119 transmits the selected Preset-ASI information to the rendering unit 1103 after bypassing the first matrix unit 1113, and the rendering unit 1103 uses the Preset-ASI information transmitted from the matrix determiner 1119. As described above, the rendering unit 1103 calculates spatial cue information $w_{modified}^{b}$ according to Eq. 9 based on a matrix calculated by Eq. 6 and a second matrix II calculated by Eq. 4. The rendering unit 303 generates a modified representative bit stream based on spatial cue parameters extracted from $w_{modified}^{b}$, for example, CLD parameters of Eq. 11 and Eq. 12.

Figure 7:
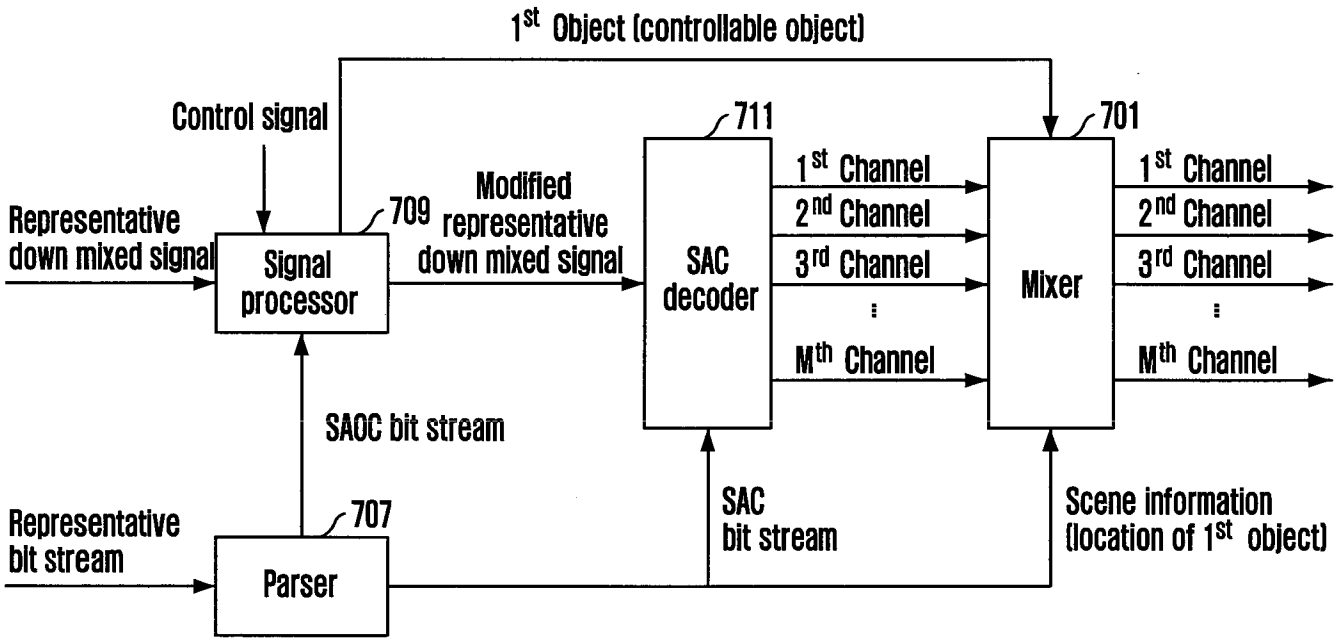
FIG. 7 is a diagram illustrating an audio decoding apparatus in accordance with another embodiment of the present invention.

FIG. 7 is a diagram illustrating an audio decoding apparatus in accordance with another embodiment of the present invention.

As shown, the audio decoding apparatus according to another embodiment of the present invention includes a parser 707, a signal processor 709, a SAC decoder 711, and a mixer 701. In the audio decoding apparatus of FIG. 7, the mixer 701 performs sound localization on audio objects when the signal processor 109 removes audio objects from a representative down mixed signal outputted from the SAOC encoders 101 and 501.

The audio decoding apparatus of FIG. 7 includes the parser 707 instead of the transcoder 107 and additionally includes the mixer 701 unlike the audio decoding apparatus of FIG. 3.

The parser 707 separates a SAOC bit stream generated by the SAOC encoder 101 and 501 and a SAC bit stream generated by the SAC encoder 103 from a representative bit stream outputted from the bit stream formatter 105 and 505 by parsing the representative bit stream. If the SAC encoder 103 is a MPS encoder, the SAC bit stream is a MPS bit stream. The parser 707 extracts location information of controllable objects, which is scene information, from the separated SAOC bit stream as audio objects inputted to the SAOC encoders 101 and 501 and transfers the extracted information to the mixer 701.

The signal processor 709 partially removes audio objects included in the representative down-mixed signal based on the representative down mixed signal outputted from the SAOC encoder 101 and SAOC bit stream information outputted from the parser 301 and outputs a modified representative down-mixed signal. For example, it was already described that the signal processor 109 outputs the modified representative down-mixed signal by removing audio objects from the representative down-mixed signal outputted from the SAOC encoder 101 and 501 except an object N which is an audio object signal outputted from the SAC encoder 105 using Eq. 2. It was also already described that the signal processor 109 outputs the modified representative down-mixed signal by removing only an object N, which is an audio object signal outputted from the SAC encoder 105, from the representative down-mixed signal outputted from the SAOC encoder 101 and 501.

In FIG. 7, the signal processor 709 outputs the modified representative down-mixed signal by removing all of audio objects except an object 1, which is controllable object signals, among audio signal objects. Or, the signal processor 709 outputs the modified representative down-mixed signal by removing only the object 1 from the audio signal objects. In case of removing all of objects except the object 1, it is not necessary to additionally extract components of the object 1. In case of removing only the object 1, the signal processor 709 extracts components of the object 1 from the representative down-mixed signal based on Eq. 21.

$$\text{Object \#1}(n)=\text{Downmixsignals}(n)-\text{ModifiedDownmixsignals}(n) \quad \text{Eq. 21}$$

In Eq. 21, Object #1($n$) is components of an object 1 included in a representative down-mixed signal, Downmixsignals(n) is a representative down mixed signal, ModifiedDownmixsignals(n) is a modified representative down mixed signal, and n denotes a time-domain sample index.

The signal processor 709 extracts the components of the object 1 from the representative down mixed signal by directly controlling parameters. For example, the signal processor 709 can extract the components of the object 1 from the representative down mixed signal based on a gain parameter calculated by Eq. 22.

$$G_{Object\#1}=\sqrt{1-(G_{\text{ModifiedDownmixsignals}})^2} \quad \text{Eq. 22}$$

In Eq. 22, $G_{Object\ \#1}$ is gain of an object 1 included in a representative down mixed signal, and $G_{ModifiedDownmixsignals}$ is gain of a modified representative down mixed signal.

The SAC decoder 711 performs the same operation of the SAC decoder 111 of FIG. 1. For example, the SAC decoder 711 is a MPS decoder. The SAC decoder 711 decodes the modified representative down mixed signal outputted from the signal processor 709 to a multichannel signal using the SAC bit stream outputted from the parser 301.

The mixer 701 mixes controllable object signals outputted from the signal processor 109, which is the object 1 of FIG. 7, with the multichannel signal outputted from the SAC decoder 711 and outputs the mixed signal. The mixer 701 decides an output channel of the controllable object based on the location information of the controllable object signal, that is, scene information, as a signal outputted from the parser 707.

Figure 8:
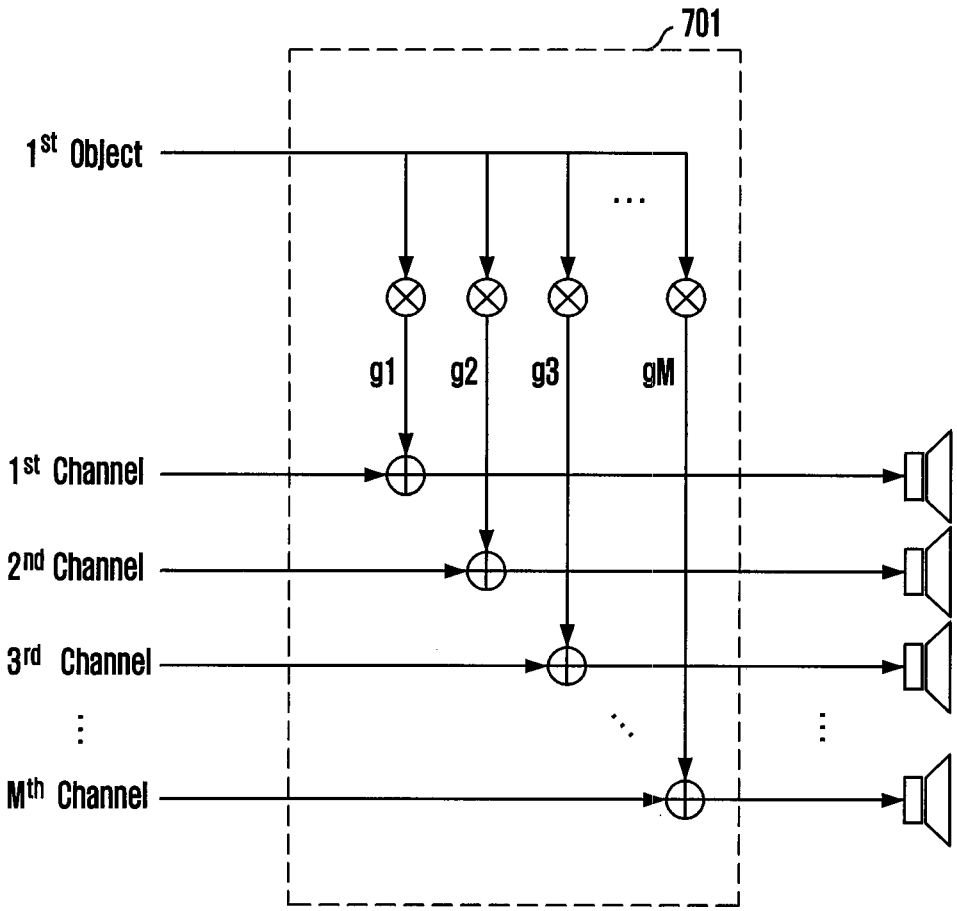
FIG. 8 is a diagram illustrating a mixer of FIG. 7.

FIG. 8 is a diagram illustrating a mixer of FIG. 7.

As shown in FIG. 8, the mixer 701 mixes a controllable object signal with a multichannel signal by multiplying gains g1 to gM of M channel signals outputted from the SAC decoder 711 with the object 1 which is a controllable object signal and adding the multiplying result to the M channel signals. For example, if the object 1 is required to locate at a first channel signal, g1=1 and remaining coefficients are all 0. For another example, if it is required to locate the object 1 between a first channel signal 1 and a second channel signal 2, $$g1 = g2 = \frac{1}{\sqrt{2}}$$

and remaining coefficients are all 0. If it is required to locate the controllable object signal between predetermined signals, each of gains is controlled according to the panning law.

When the signal processor 709 outputs the modified representative down-mixed signal by removing all of objects except the first object 1, the SAC decoder 711 may not process the modified representative down mixed signal. Instead of not processing, the mixer 701 mixes signals by multiplying the first object 1 which is controllable object signal outputted from the signal processor 709 with the g1 to gM. For example, if it is required to locate the first object 1 at a first channel signal, g1=1 and remaining coefficients are all 0. As another example, if it is required to locate the first object 1 between the first channel signal and the second channel signal, $$g1 = g2 = \frac{1}{\sqrt{2}}$$

and remaining coefficients are 0. If it is required to locate a controllable object signal between predetermined signals, each of gain values is controlled according to the panning law. If the first object 1 is a stereo channel object signal, g1 and g2 are set to 1 and remaining coefficients are set to 0, thereby generating the first object as a stereo channel signal.

Panning means a process for locating the controllable object signal between output channel signals.

A mapping method employing the panning law is generally used to map an input audio signal between output audio signals. The panning law may include a Sine Panning law, a Tangent Panning law, a Constant Power Panning law (CPP law). Any methods can archive the same object through the panning law.

Hereinafter, a method for mapping an audio signal to a target location according to the CPP law according to an embodiment of the present invention will be described. However, it is obvious that the present invention can be applied to various panning laws. That is, the present invention is not limited to the CPP law.

According to an embodiment of the present invention, a multi object or multi channel audio signal is paned according to the CPP for a given panning angle.

Figure 9:
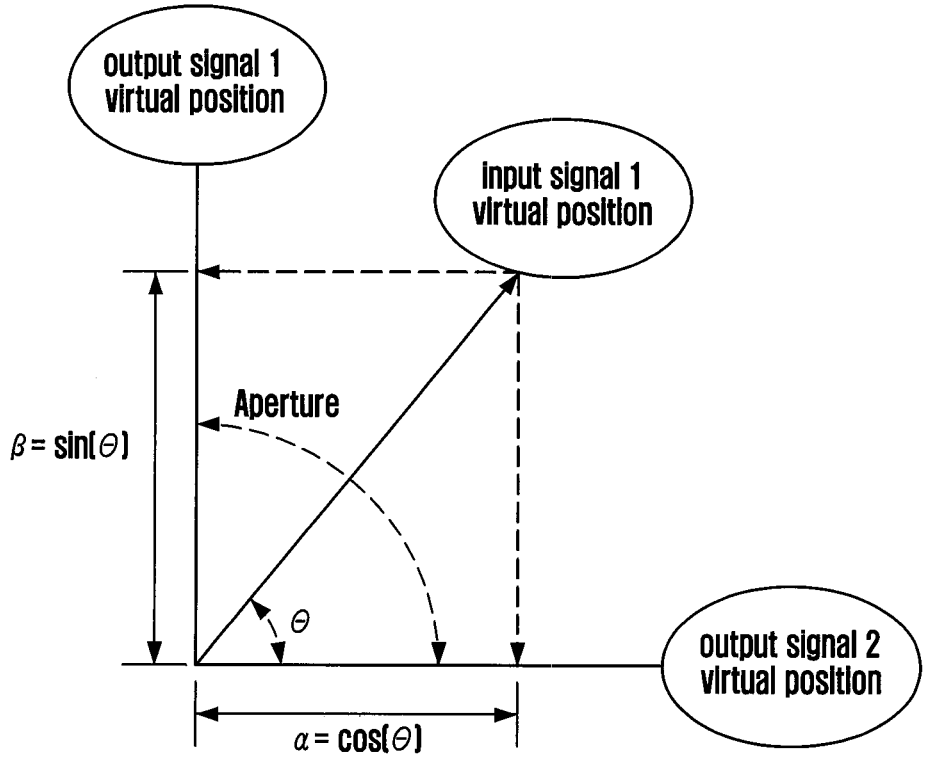
FIG. 9 is a diagram for describing a method for mapping an audio signal to a target location by applying CPP in accordance with an embodiment of the present invention.

FIG. 9 is a diagram for describing a method for mapping an audio signal to a target location by applying CPP in accordance with an embodiment of the present invention. As shown in FIG. 9, the locations of the output signals ${}_{out}g_m^1$ and ${}_{out}g_m^2$ are 0 degree and 90 degree, respectively. Therefore, an aperture is about 90 degree in FIG. 9.

If a first input audio signal $g_m^1$ is located at a position θ between a first output signal ${}_{out}g_m^1$ and a second output signal ${}_{out}g_m^2$, α,β are defined as α=cos(θ), β=sin(θ). According to the CPP law, α,β values are calculated by projecting a location of an input audio signal on an axis of an output audio signal and using sine and cosine functions, and an audio signal is rendered by calculating controlled power gain. Power gain ${}_{out}G_m$ calculated and controlled based on α,β values is expressed as Eq. 23.

$$ {}_{out}G_m = \begin{bmatrix} {}_{out}g_m^1 \\ {}_{out}g_m^2 \\ \vdots \\ {}_{out}g_m^M \end{bmatrix} = \begin{bmatrix} g_m^1 \times \beta \\ g_m^1 \times \alpha + g_m^2 \\ \vdots \\ g_m^M \end{bmatrix} \quad \text{Eq. 23} $$

In Eq. 23, α=cos(θ), β=sin(θ).

Eq. 24 expresses it in more detail.

$$ {}_{out}G_m = \begin{bmatrix} {}_{out}g_m^1 \\ {}_{out}g_m^2 \\ \vdots \\ {}_{out}g_m^M \end{bmatrix} = \overbrace{\begin{bmatrix} \beta & 0 & \dots & 0 \\ \alpha & 1 & \dots & 0 \\ \vdots & \vdots & \ddots & \vdots \\ 0 & 0 & \dots & 1 \end{bmatrix}}^{M} \begin{bmatrix} g_m^1 \\ g_m^2 \\ \vdots \\ g_m^M \end{bmatrix} \quad \text{Eq. 24} $$

The a and b values may be changed according to the panning law. The a and b values are calculated by mapping power gain of an input audio signal to a virtual location of an output audio signal to be suitable to an aperture.

Hereinbefore, the encoding process, the transcoding process, and the decoding process according to the present embodiment were described in a view of an apparatus. Each of constituent elements included in the apparatus may be equivalent to processing blocks. In this case, it is obvious to those skilled in the art that the present invention can be understood in a view of a method.

For example, an audio encoding apparatus including the SAOC encoder 101 or 501, the SAC encoder 103, the bit stream formatter 105 or 505, and the Preset-ASI unit 113 of FIG. 1 or FIG. 5 performs an audio encoding method including: down-mixing an audio signal including a plurality of channels, generating a spatial cue for the audio signal including a plurality of channels, and generating first rendering information having the generated spatial cue; and down-mixing an audio signal including a plurality of objects having the down-mixed signal, generating a spatial cue for the audio signal including a plurality of objects, and generating second rendering information having the generated spatial cue. In the down mixing an audio signal including a plurality of channels, a spatial cue for the audio signal including a plurality of objects not limited by a CODEC scheme that limits the down mixing an audio signal including a plurality of channel.

The audio encoding apparatus may perform an audio encoding method including: down mixing an audio signal including a plurality of channels, generating a spatial cue for the audio signal including a plurality of channels, and generating first rendering information including the generated spatial cue; down-mixing an audio signal including a plurality of objects, which includes the down-mixed signal from the down mixing an audio signal including a plurality of channels, generating a spatial cue for the audio signal including the plurality of objects, and generating second rendering information including the generated spatial cue; and down-mixing an audio signal including a plurality of object, which includes the down mixed signal from the down mixing an audio signal including a plurality of objects, generating a spatial cue for the audio signal including the plurality of objects, and generating third rendering information including the generated spatial cue. In the down mixing an audio signal including a plurality of objects, a spatial cue for the audio signal including the plurality of objects is generated in regardless of a CODEC scheme that limits the down mixing an audio signal including a plurality of channels and the down mixing an audio signal including a plurality of objects.

Also, the transcoder including the parser 301, 601, and 1101, the rendering unit 303, 603, and 1103, the sub-band converter 305, 605, and 1105, the second matrix unit 311, 611, and 1111, the first matrix unit 313, 613, and 1113, the Preset-ASI extractor 1117, and the matrix determiner 1119 shown in FIGS. 3, 6, and 11 may perform a transcoding method including: generating rendering information including information for mapping an encoded audio signal to an output channel of an audio decoding apparatus based on object control information including location and level information of the encoded audio signal and output layout information; generating channel restoration information for a audio signal including a plurality of channels included in the encoded audio signal based on first rendering information including a spatial cue for the audio signal; converting second rendering information having a spatial cue for an audio signal including a plurality of objects included in the encoded audio signal into rendering information following the CODEC scheme, where the second rendering information includes a spatial cue not limited by a CODEC scheme that limits the first rendering information; and generating modified rendering information for the encoded audio signal based on the rendering information generated by the first matrix means, the rendering information generated by the second matrix means, and the converted rendering information from the sub-band converting means.

The transcoder may perform a transcoding method including: extracting predetermined Preset-ASI from rendering information; generating rendering information including information for mapping the encoded audio signal to an output channel of an audio decoding apparatus based on object control information directly expressing location and level information of the encoded audio signal and output layout information as the extracted Preset-ASI; generating channel restoration information for an audio signal including a plurality of channels based on first rendering information; converting third rendering information to rendering information following the CODEC scheme; and generating modified rendering information for the encoded audio signal based on one of the extracted Preset-ASI and the generated rendering information from the generating rendering information, the generated rendering information from the generating channel restoration information, and the converted rendering information.

Also, the transcoder may perform a transcoding method including: generating rendering information including information for mapping the encoded audio signal to an output channel of an audio decoding apparatus based on object control information having location and level information of the encoded audio signal and output layout information; generating channel restoration information for an audio signal including a plurality of channels based on first rendering information; converting third rendering information to rendering information following the CODEC scheme; and generating modified rendering information for the encoded audio signal based on the generated rendering information from the generating rendering information, the generated rendering information from the generating channel restoration information, the converted rendering information from the converting third rendering information, and second rendering information.

The transcoder may perform a transcoding method including: extracting predetermined Preset-ASI from rendering information; generating rendering information including information for mapping the encoded audio signal to an output channel of an audio decoding apparatus based on object control information directly expressing location and level information of the encoded audio signal and output layout information as the extracted Preset-ASI; generating channel restoration information for an audio signal including a plurality of channels based on first rendering information; converting third rendering information to rendering information following the CODEC scheme; and generating modified rendering information for the encoded audio signal based on one of the extracted Preset-ASI and the generated rendering information from the generating rendering information, the generated rendering information from the generating channel restoration information, and the converted rendering information.

The decoding apparatus including the parser 707, the signal processor 709, the SAC decoder 711, and the mixer 701 shown in FIG. 1 or FIG. 7 may perform an audio decoding method including: separating rendering information of a multi object signal including a spatial cue for an audio signal including a plurality of objects and scene information of the audio signal including a plurality of objects from rendering information for a multi object audio signal including a plurality of channels; outputting a modified down mixed signal by performing high suppression on an audio object signal for an audio signal including a plurality of channels among down mixed signals for the multi object audio signal including a plurality of channels based on rendering information of the multi object signal; and restoring an audio signal by mixing the modified down mixed signal based on the scene information.

The decoding apparatus may also perform an audio decoding method including: separating rendering information of a multi channel signal including a spatial cue for an audio signal including a plurality of channels, rendering information of a multi object signal including a spatial cue for an audio signal including a plurality of object, and scene information of the audio signal including a plurality of objects from rendering information for a multi object signal including a plurality of channels; generated a modified down mixed signal and a high-suppressed audio object signal by performing high suppression on at least one of audio object signals among down mixed signals for the multi object audio signal including a plurality of channels based on the rendering information of the multi object signal; restoring a multi channel audio signal by mixing the modified down mixed signal; and mixing the modified down mixed signal and an audio object signal generated by the signal processing means based on the scene information.

The above described method according to the present invention can be embodied as a program and stored on a computer readable recording medium. The computer readable recording medium is any data storage device that can store data which can be thereafter read by the computer system. The computer readable recording medium includes a read-only memory (ROM), a random-access memory (RAM), a CD-ROM, a floppy disk, a hard disk and an optical magnetic disk.

While the present invention has been described with respect to the specific embodiments, it will be apparent to those skilled in the art that various changes and modifications may be made without departing from the spirit and scope of the invention as defined in the following claims.

INDUSTRIAL APPLICABILITY

According to the present invention, a user is enabled to encode and decode a multi object audio signal with multi channel in various ways. Therefore, audio contents can be actively consumed according to a user's need.

What is claimed is:

1. An audio encoding apparatus comprising:

a multi channel encoding means for down-mixing an audio signal including a plurality of channels, generating a spatial cue for the audio signal including the plurality of channels, and generating first rendering information including the generated spatial cue; and a multi object encoding means for down-mixing an audio signal including a plurality of objects, which includes the down-mixed signal from the multi channel encoding means, generating a spatial cue for the audio signal including the plurality of objects, and generating second rendering information including the generated spatial cue, wherein the multi channel encoding means generates a spatial cue for the audio signal including the plurality of objects regardless of a Coder-DECoder (CODEC) scheme the limits the multi channel encoding means, wherein the multi object encoding means generates a spatial cue for a subordinate sub-band limited by the CODEC scheme as a spatial cue for the audio signal including the plurality of objects.

2. The audio encoding apparatus of claim 1, wherein the multi object encoding means includes index information of a subordinate sub-band corresponding to a spatial cue most similar to a spatial cue for one of sub-bands limited by the CODEC scheme among the additional subordinate sub-bands.

3. The audio encoding apparatus of claim 2, wherein the multi object encoding means generates a spatial cue for the audio signal including the plurality of objects as a spatial cue except a spatial cue limited by the CODEC scheme.

4. An audio encoding apparatus comprising:

a multi channel encoding means for down-mixing an audio signal including a plurality of channels, generating a spatial cue for the audio signal including a plurality of channels, and generating first rending information including the generated spatial cue;

a first multi object encoding means for down-mixing an audio signal including a plurality of objects having the down-mixed signal from the multi channel encoding means, generating a spatial cue for the audio signal including the plurality of objects, and generating second rendering information including the generated spatial cue; and a second multi object encoding means for down-mixing an audio signal including a plurality of objects, which includes the down mixed signal from the first multi object encoding means, generating a spatial cue for the audio signal including the plurality of objects, and generating third rendering information including the generated spatial cue, wherein the second multi object encoding means generates a spatial cue for the audio signal including the plurality of objects without being limited by a CODEC scheme that the multi channel encoding means and the first multi object encoding means are limited by.

5. The audio encoding apparatus of claim 4, wherein the second multi object encoding means generates a spatial cue for a subordinate sub-band limited by the CODEC scheme as a spatial cue for the audio signal including the plurality of objects.

6. The audio encoding apparatus of claim 5, wherein the second multi object encoding means includes index information of a subordinate sub-band corresponding to a spatial cue most similar to a spatial cue for one of sub-bands limited by the CODEC scheme among the additional subordinate sub-bands.

7. The audio encoding apparatus of claim 6, wherein the second multi object encoding means generates a spatial cue for the audio signal including the multiple objects as a spatial cue other than the spatial cues limited by the CODEC scheme.

8. An audio decoding apparatus comprising:

a parsing means for separating rendering information of a multi object signal including a spatial cue for an audio signal including a plurality of objects and scene information of the audio signal including a plurality of objects from rendering information for a multi object audio signal including a plurality of channels;

a signal processing means for outputting a modified down mixed signal by performing high suppression on an audio object signal for an audio signal including a plurality of channels among down mixed signals for the multi object audio signal including a plurality of channels based on rendering information of the multi object signal, wherein the signal processing means outputs the modified representative down mixed signal by removing an object 1, which is controllable object signal, from audio signal objects based on the following equation:

$$\text{Object } 1(n)=\text{Downmixsignals}(n)-\text{ModifiedDownmixsignals}(n),$$

wherein Object 1($n$) is components of the object 1 included in a representative down mixed signal, Downmixsignals (n) is a representative down mixed signal, Modified-Downmixsignals(n) is a modified representative down mixed signal, and n denotes a time-domain sample index; and a mixing means for restoring an audio signal by mixing the modified down mixed signal based on the scene information.

9. An audio decoding apparatus, comprising:

a parsing means for separating rendering information of a multi channel signal including a spatial cue for an audio signal including a plurality of channels, rendering information of a multi object signal including a spatial cue for an audio signal including a plurality of object, and scene information of the audio signal including a plurality of objects from rendering information for a multi object signal including a plurality of channels;

a signal processing means for generating a modified down mixed signal and a high-suppressed audio object signal by performing high suppression on at least one of audio object signals among down mixed signals for the multi object audio signal including a plurality of channels based on the rendering information of the multi object signal, wherein the signal processing means outputs the modified representative down mixed signal by removing an object 1, which is controllable object signal, from audio signal objects based on the following equation:

$$\text{Object } 1(n)=\text{Downmixsignals}(n)-\text{ModifiedDownmixsignals}(n),$$

wherein Object 1($n$) is components of the object 1 included in a representative down mixed signal, Downmixsignals (n) is a representative down mixed signal, Modified-Downmixsignals(n) is a modified representative down mixed signal, and n denotes a time-domain sample index, wherein the signal processing means extracts the components of the object 1 based on the following equation:

$$G_{object\ 1}=[1-(G_{ModifiedDownmixsignals})^2]^{1/2},$$

wherein $G_{oject\ 1}$ is gain of the object 1 included in a representative down mixed signal, and $G_{ModifiedDownmixsignals}$ is gain of a modified representative down mixed signal;

a channel decoding means for restoring a multi channel audio signal by mixing the modified down mixed signal; and a mixing means for mixing the modified down mixed signal and an audio object signal generated by the signal processing means based on the scene information.

10. An audio decoding method, comprising:

receiving an audio coding signal including a down mixed signal and a supplementary information signal;

extracting multi object supplementary information and multi channel supplementary information from the supplementary information signal;

converting the down mixed signal to a multi channel down mixed signal based on the multi object supplementary information;

decoding a multi channel audio signal using the multi channel down mixed signal and the multi channel supplementary information;

outputting a modified representative down mixed signal by removing an object 1, which is controllable object signal, from audio signal objects based on the following equation:

$$\text{Object } 1(n)=\text{Downmixsignals}(n)-\text{ModifiedDownmixsignals}(n),$$

wherein Object 1($n$) is components of the object 1 included in a representative down mixed signal, Downmixsignals (n) is a representative down mixed signal, Modified-Downmixsignals(n) is a modified representative down mixed signal, and n denotes a time-domain sample index, wherein the signal processing means extracts the components of the object 1 based on the following equation:

$$G_{Object\ 1}=[1-(G_{ModifiedDownmixsignals})^2]^{1/2},$$

wherein $G_{object\ 1}$ is gain of the object 1 included in a representative down mixed signal, and $G_{ModifiedDownmixsignals}$ is gain of a modified representative down mixed signal; and mixing the decoded audio signal.

11. The audio decoding method of claim 10, wherein in said converting the down mixed signal to a multi channel down mixed signal, a target audio object signal to control is additionally separated, and the multi channel down mixed signal is generated using remaining audio object signal, and the additionally separated audio object signal is used in said mixing the decoded audio signal after performing a predetermined control operation.

12. The audio decoding method of claim 10, wherein the audio coding signal includes Preset Audio Scene Information (Preset-ASI), and the multi channel supplementary information is modified based on the Preset-ASI before performing said decoding a multi channel audio signal.

13. An audio encoding apparatus comprising:

an input unit for receiving a multi channel audio signal and a multi object audio signal; and an encoding unit for encoding the received audio signal to a down mixed signal and rendering information, wherein the encoding unit comprises a multi object encoder, wherein the multi object encoder generates a spatial cue for a subordinate sub-band limited by a Coder-DECoder (CODEC) scheme as a spatial cue for the received audio signal including a plurality of objects, wherein the rendering information includes multi channel coding supplementary information and multi object coding supplementary information, wherein the signal processing means extracts the components of the object 1 based on the following equation:

$$G_{object\ 1}=[1-(G_{ModifiedDownmixsignals})^2]^{1/2},$$

wherein $G_{object\ 1}$ is gain of the object 1 included in a representative down mixed signal, and $G_{ModifiedDownmixsignals}$ is gain of a modified representative down mixed signal.

14. The audio encoding apparatus of claim 13, wherein the multi channel coding supplementary information includes Spatial Audio Coding (SAC) spatial cue information, and the multi object coding supplementary information includes Spatial Audio Object Coding (SAOC) spatial cue information.

15. The audio encoding apparatus of claim 14, further comprising a bit stream formatter for combining the multi channel coding supplementary information and the multi object coding supplementary information.

16. The audio encoding apparatus of claim 13, wherein the encoding unit further includes a multi channel encoder.

17. The audio encoding apparatus of claim 16, wherein the multi channel encoder performs a SAC coding operation, and the multi object encoder includes:

a first multi object encoder for performing a SAC scheme based SAOC coding operation; and a second multi object encoder for performing a SAOC coding operation in regardless of the SCA scheme.

18. The audio encoding apparatus of claim 17, further comprising a bit stream formatter combines SAC supplementary information outputted from the multi channel encoder, first SAOC supplementary information outputted from the first multi object encoder, and SAOC supplementary information outputted from the second multi object encoder.

19. The audio encoding apparatus of claim 13, wherein the multi object encoder includes index information of a subordinate sub-band corresponding to a spatial cue most similar to a spatial cue for one of sub-bands limited by the CODEC scheme among the additional subordinate sub-bands.

* * * * *